US012064026B2

(12) United States Patent
Wilsey et al.

(10) Patent No.: US 12,064,026 B2
(45) Date of Patent: Aug. 20, 2024

(54) INTERCHANGEABLE HARNESS ASSEMBLY FOR A USER-WORN ELECTRICAL APPLIANCE

(71) Applicant: Emerson Electric Co., St. Louis, MO (US)

(72) Inventors: Gregory Wilsey, Wildwood, MO (US); Jeremy Nathan Sanders, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 279 days.

(21) Appl. No.: 17/445,798

(22) Filed: Aug. 24, 2021

(65) Prior Publication Data

US 2023/0060981 A1 Mar. 2, 2023

(51) Int. Cl.

| | |
|---|---|
| ***A45F 3/14*** | (2006.01) |
| ***A45F 3/12*** | (2006.01) |
| ***A47L 5/36*** | (2006.01) |
| ***A47L 9/22*** | (2006.01) |

(52) U.S. Cl.

CPC ..... *A45F 3/14* (2013.01); *A47L 5/36* (2013.01); *A47L 9/22* (2013.01); *A45F 2003/146* (2013.01)

(58) Field of Classification Search

CPC . A45F 3/14; A45F 2003/122; A45F 2003/146

USPC ..... 224/628

See application file for complete search history.

(56) References Cited

U.S. PATENT DOCUMENTS

| | | | | | |
|---|---|---|---|---|---|
| 4,526,298 | A * | 7/1985 | Boxer | A45F 3/16 | 222/529 |
| 5,267,371 | A * | 12/1993 | Soler | A47L 9/1633 | 15/327.5 |
| 5,823,414 | A * | 10/1998 | Gal | A45F 3/04 | 224/636 |
| 5,954,250 | A * | 9/1999 | Hall | A62B 25/00 | 224/629 |
| 5,954,253 | A | 9/1999 | Swetish | | |
| 6,553,610 | B1 * | 4/2003 | Shideler | A47L 5/36 | 15/327.5 |

(Continued)

FOREIGN PATENT DOCUMENTS

| | | | |
|---|---|---|---|
| AU | 2018211203 | A1 | 5/2019 |
| EP | 1466550 | A1 | 10/2004 |
| WO | 2017088022 | A1 | 6/2017 |

*Primary Examiner* — Nathan J Newhouse
*Assistant Examiner* — Lester L Vanterpool
(74) *Attorney, Agent, or Firm* — Armstrong Teasdale LLP

(57) ABSTRACT

A harness assembly for an electrical appliance includes an upper support assembly and a lower support assembly. The upper support assembly includes an upper back pad and at least one shoulder strap emanating from the upper back pad. The upper back pad includes an upper pocket that receives an upper mounting plate of the electrical appliance therein, and an upper flap selectively connectable to the upper pocket to close the upper pocket and retain the upper mounting plate within the upper pocket. The lower support assembly includes a lower back pad and a waist belt emanating from the lower back pad. The lower back pad includes a lower pocket that receives a lower mounting plate of the electrical appliance therein, and a lower flap selectively connectable to the lower pocket to close the lower pocket and retain the lower mounting plate within the lower pocket.

20 Claims, 17 Drawing Sheets

(56) References Cited

U.S. PATENT DOCUMENTS 6,892,915 B2 * 5/2005 Mares ..... A45F 3/20 224/630
7,770,766 B2 * 8/2010 Foissac ..... A45F 3/047 224/628
8,032,980 B2 10/2011 Basenberg
8,181,833 B2 5/2012 Wangeby
8,857,681 B2 * 10/2014 Burnett ..... A44B 11/005 24/3.1
8,991,671 B2 * 3/2015 Gill ..... A45F 3/08 224/628
9,220,333 B2 * 12/2015 Losos ..... A45F 3/047
9,271,559 B2 * 3/2016 Gleason ..... A45F 3/14
9,289,051 B1 * 3/2016 Capps ..... A45F 3/04
9,700,122 B2 * 7/2017 Pelland ..... A41D 13/0531
9,820,555 B2 * 11/2017 Beck ..... A45F 3/14
9,999,290 B2 * 6/2018 Klein ..... A45F 3/08
10,230,077 B2 * 3/2019 Rief ..... H01M 50/247
10,368,626 B2 * 8/2019 Roque ..... A45F 3/04
10,383,426 B2 * 8/2019 Rittenhouse ..... A45F 3/10
11,109,663 B2 * 9/2021 Hoge ..... A01M 31/006
2007/0174992 A1 8/2007 Murray
2007/0292749 A1 12/2007 Coombs
2012/0227209 A1 9/2012 Vinson
2013/0312150 A1 * 11/2013 Klein ..... A45F 3/08 2/2.5
2014/0124561 A1 * 5/2014 Neibarger ..... F41H 1/02 224/625
2016/0033235 A1 * 2/2016 Kinnings ..... A45F 3/12 2/102
2016/0106199 A1 * 4/2016 Hairston ..... A45F 3/14 224/633
2019/0000287 A1 1/2019 Duong
2019/0298122 A1 10/2019 Tahara
2020/0315325 A1 * 10/2020 Truelove, III ..... A45F 3/04

* cited by examiner

INTERCHANGEABLE HARNESS ASSEMBLY FOR A USER-WORN ELECTRICAL APPLIANCE

FIELD

The field of the disclosure relates generally to electrical appliances, and, more particularly, to interchangeable harness assemblies for user-worn electrical appliances.

BACKGROUND

Appliances, such as vacuum cleaners, may be carried on a user's shoulders and back using a harness. At least some know harnesses include various flexible and/or adjustable straps allowing a user to customize the fit of the harness. For example, at least some known harnesses include a pair of shoulder straps and a waist belt each including one or more adjustable components, such as slide buckles, enabling a user to selectively adjust the length of the straps and/or the belt in order to adjust the tightness of the harness. In some known cases, the harness is worn by multiple users of the appliance. Each new user must re-adjust the straps and belt in order to alter the fit of the harness to accommodate the height and weight of the new user.

Furthermore, users may wear the harness for extended periods of time while the user performs one or more manual labor tasks, for example performing a vacuuming operation using the vacuum cleaner supported by the harness. In some known cases, users wearing the harness perform physically demanding operations while working within various environments, exposing the harness to contaminants, debris, and/or sweat of the user. The harness may therefore be interchanged with a new harness or washed and/or sanitized before another user uses the appliance. At least some known harnesses require the use of one or more tools (e.g., screwdrivers, wrenches, etc.) to connect and disconnect the harness from an electrical appliance, such as a vacuum cleaner.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a harness assembly for an electrical appliance includes an upper support assembly and a lower support assembly. The upper support assembly includes an upper back pad and at least one shoulder strap emanating from the upper back pad. The upper back pad includes a first side and an opposing second side, where the first side is adapted to engage a user's back when the harness assembly is worn by the user. The upper back pad includes an upper pocket located on the second side of the upper back pad. The upper pocket is sized and shaped to receive an upper mounting plate of the electrical appliance therein. The upper back pad also includes an upper flap selectively connectable to the upper pocket to close the upper pocket and retain the upper mounting plate within the upper pocket. The lower support assembly includes a lower back pad and a waist belt emanating from the lower back pad. The lower back pad includes a first side and an opposing second side, where the first side is adapted to engage the user's back when the harness assembly is worn by the user. The lower back pad includes a lower pocket located on the second side of the lower back pad. The lower pocket is sized and shaped to receive a lower mounting plate of the electrical appliance therein. The lower back pad also includes a lower flap selectively connectable to the lower pocket to close the lower pocket and retain the lower mounting plate within the lower pocket.

In another aspect, a vacuum cleaner system includes a vacuum cleaner and a harness assembly removably connectable to the vacuum cleaner. The vacuum cleaner includes a housing, a debris chamber defined within the housing, a motor assembly connected to the housing and operable to generate airflow through the debris chamber, an upper mounting plate connected to the housing, and a lower mounting plate connected to the housing. The harness assembly includes an upper support assembly and a lower support assembly. The upper support assembly includes an upper back pad, at least one shoulder strap emanating from the upper back pad, an upper pocket in which the upper mounting plate is received, and an upper flap selectively connectable to the upper pocket to close the upper pocket and retain the upper mounting plate within the upper pocket. The lower support assembly includes a lower back pad, a waist belt emanating from the lower back pad, a lower pocket in which the lower mounting plate is received, and a lower flap selectively connectable to the lower pocket to close the lower pocket and retain the lower mounting plate within the lower pocket.

In yet another aspect, a method of using an interchangeable harness assembly for an electrical appliance is provided. The interchangeable harness assembly includes an upper support assembly and a lower support assembly. The upper support assembly includes an upper back pad and the lower support assembly includes a lower back pad. The method includes inserting an upper mounting plate of the electrical appliance into an upper pocket of the upper back pad, securing the upper mounting plate within the upper pocket by selectively attaching an upper flap of the upper back pad to the upper pocket, inserting a lower mounting plate of the electrical appliance into a lower pocket of the lower support assembly, and securing the lower mounting plate within the lower pocket by selectively attaching a lower flap of the lower back pad to the lower pocket.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the drawings.

DETAILED DESCRIPTION

Figure 1:
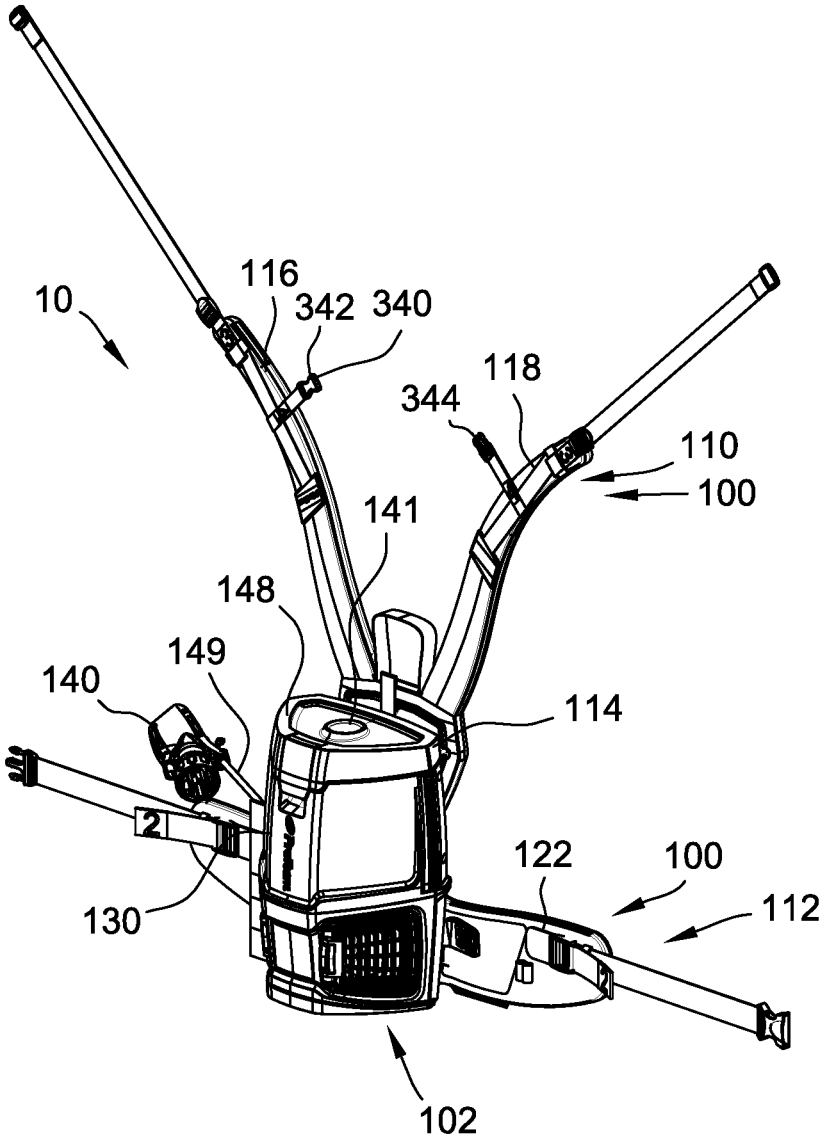
FIG. 1 is a front perspective view of an example electrical appliance, illustrated in the form of a backpack vacuum cleaner, including an interchangeable harness assembly.
Figure 2:
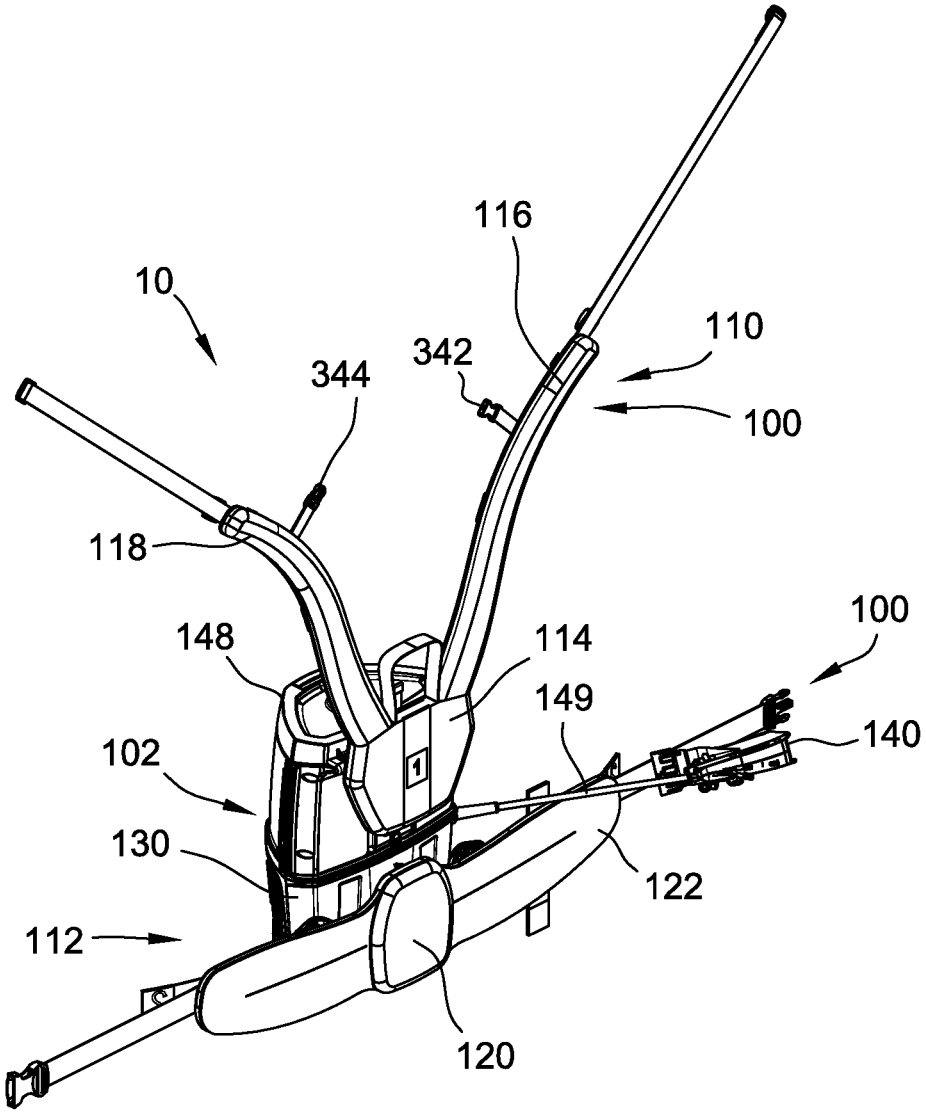
FIG. 2 is a rear perspective view of the electrical appliance shown in FIG. 1.

FIG. 1 is a front perspective view of an example electrical appliance 10, illustrated in the form of a corded backpack vacuum cleaner. FIG. 2 is a rear perspective view of the electrical appliance shown in FIG. 1. Although the appliance 10 is shown and described herein with reference to a backpack-mounted vacuum cleaner, electrical appliances consistent with this disclosure may be embodied in other types and in other combinations including, for example and without limitation, wet/dry vacuum cleaners, blowers, sprayers, and power tools and equipment.

In the example embodiment, the appliance 10 includes a vacuum cleaner assembly 102 that is carried on a user's back via a harness or backpack assembly 100, and a vacuum conduit 128 (shown in FIG. 3) connected to the vacuum cleaner assembly 102. The vacuum conduit 128 can generally include any suitable conduit 128 for directing suction and/or forced air generated by the electrical appliance 10, including, for example and without limitation, vacuum hoses, vacuum wands or tubes, surface cleaning tools, and combinations thereof.

The harness assembly 100 is sized and shaped to be worn by a user of the electrical appliance 10, for example, on the user's back or shoulders, to facilitate carrying the electrical appliance 10 during use. In the illustrated embodiment, the harness assembly 100 is interchangeable and may be selectively connected to and/or disconnected from the electrical appliance 10 to allow the harness assembly 100 to be replaced and/or exchanged in order to clean and/or repair the harness assembly 100 and/or the electrical appliance 10. Additionally, the harness assembly 100 enables a plurality of users to selectively connect a personal harness assembly to a shared electrical appliance 10. In the illustrated embodiment, the harness assembly 100 may be easily and quickly attached and detached from the electrical appliance 10 without requiring the use of tools (e.g., screwdrivers, wrenches, etc.) and/or machinery (e.g., drills, impact drivers, etc.).

Figure 3:
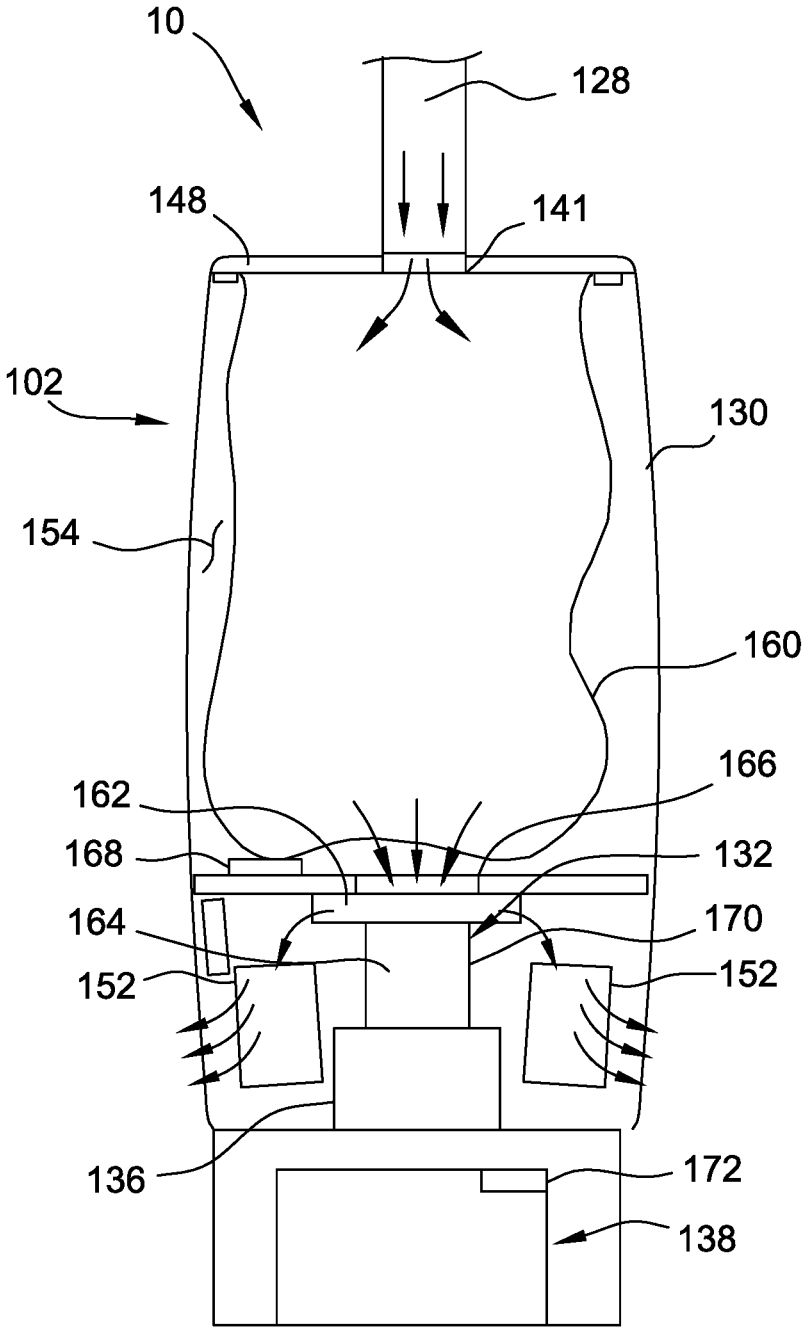
FIG. 3 is a schematic view of the electrical appliance shown in FIGS. 1-2.

With additional reference to FIG. 3, the vacuum cleaner assembly 102 includes a vacuum cleaner housing 130, a suction unit 132 enclosed within the housing 130, and a controller 136. The components and connections shown in FIG. 3 are a functional example only. Other embodiments may include different components, more or fewer components, components connected to different components, and/or different connections. The vacuum cleaner housing 130 defines an inlet 141, at least one exhaust or outlet 152, and a debris chamber 154 connected in fluid communication between the inlet 141 and the outlet 152. In the example embodiment, the inlet 141 is defined at a top of the housing 130, and the housing 130 includes two outlets 152 defined adjacent a bottom of the housing 130. In other embodiments, the inlet 141 and the outlet(s) 152 can be defined at any suitable portion of the vacuum cleaner assembly 102 that enables the electrical appliance 10 to function as described herein. Further, the vacuum cleaner assembly 102 can include more than or fewer than two outlets 152.

In the illustrated embodiment, the vacuum cleaner housing 130 includes an access door or lid 148 that provides access to the debris chamber 154, for example, to empty debris collected within the debris chamber 154. The inlet 141 is defined in the lid 148 in the example embodiment. Further, the example housing 130 is adapted to receive a filter 160 within the debris chamber 154 to filter out fine debris and small particles from the air flow through the housing 130. In the illustrated embodiment, the filter 160 is a bag filter, although the electrical appliance 10 can be operable with other types of filters, including, for example and without limitation, cartridge filters.

The suction unit 132 is operable to generate airflow through the housing 130 from the inlet 141 to the outlet 152 so as to draw debris into the debris chamber 154 through the inlet 141 by way of the vacuum conduit 128. The suction unit 132 includes a fan or impeller 162 and a motor 164 operatively connected to the impeller 162 (collectively referred to herein as a "motor assembly") to drive the impeller 162 and generate airflow through the housing 130. The motor assembly is connected to the housing 130 and positioned adjacent the debris chamber 154 such that the impeller 162 receives airflow through an impeller inlet 166 defined by the housing 130. In certain embodiments, the motor assembly can also be adapted to operate in a "reverse" mode in which the motor assembly generates airflow from the outlet 152 to the inlet 141, so as to enable the electrical appliance 10 to operate as a blower.

A suitable power source supplies electrical power to components of the electrical appliance 10, such as the motor 164 and the controller 136, and can generally include any suitable power source that enables the electrical appliance 10 to operate as described herein. Suitable types of power sources include, for example and without limitation, DC power sources, such as battery packs, and AC power sources, such as mains AC electricity from a household or commercial wall outlet. In the illustrated embodiment, the power source is an AC power source provided by a wall outlet, and the electrical appliance 10 includes a power cord 149 with an electrical plug disposed on an end thereof for electrical connection to the wall outlet. The power cord 149 is electrically connected to the electrical appliance 10 to supply AC power thereto. The electrical appliance 10 of the illustrated embodiment includes a power cord restraint assembly 140 that facilitates maintaining connection between the power cord 149 of the electrical appliance 10 and an external power cord (e.g., an extension cord connected to a wall outlet, not shown).

The electrical appliance 10 can also include an on-board or portable power source 138, such as a battery or battery pack. In such embodiments, the power cord 149 can be used to supply AC power to the electrical appliance 10, which is converted to DC, to charge the battery, in addition to or as an alternative to supplying power to other components the electrical appliance 10. In such embodiments, the electrical appliance 10 may be selectively operated in a cordless mode, in which the portable power source 138 is electrically connected to the electrical appliance 10, and a corded mode, in which the power cord 149 is electrically connected to the electrical appliance 10 and supplies AC power to the electrical appliance 10 (e.g., from a wall outlet). Other embodiments may be operated only from a battery or only from AC power.

The illustrated electrical appliance 10 also includes a plurality of sensors 168, 170, 172 connected to the controller 136. The sensors 168, 170, 172 can provide feedback to the controller 136 regarding operation of the electrical appliance 10, and the controller 136 can control the electrical appliance 10 based on feedback received from the sensors 168, 170, 172. Sensors 168, 170, 172 can include, for example and without limitation, proximity sensors, pressure sensors, temperature sensors, voltage sensors, and active or passive current sensors.

With reference to FIGS. 1 and 2, the example harness assembly 100 includes an upper support assembly 110 and a lower support assembly 112. The upper support assembly 110 includes an upper back pad 114 and a first shoulder strap 116 (e.g., a left shoulder strap 116) and a second shoulder strap 118 (e.g., a right shoulder strap 118) emanating from the upper back pad 114. The lower support assembly 112 includes a lower back pad 120 and a waist belt 122 emanating from the lower back pad 120.

In the illustrated embodiment, the harness assembly 100 is selectively engaged with or connected to the electrical appliance 10 such that the upper support assembly 110 and the lower support assembly 112 may be attached and detached from the electrical appliance 10. In the illustrated embodiment, the upper support assembly 110 and the lower support assembly 112 may be attached and detached from the electrical appliance 10 by an operator without the use of tools or machinery. In the illustrated embodiment, the upper support assembly 110 and the lower support assembly 112 are separate pieces, i.e., the upper support assembly 110 and the lower support assembly 112 are not attached or connected. In other embodiments, the upper support assembly 110 and the lower support assembly 112 are connected together or formed integrally together.

Figure 4:
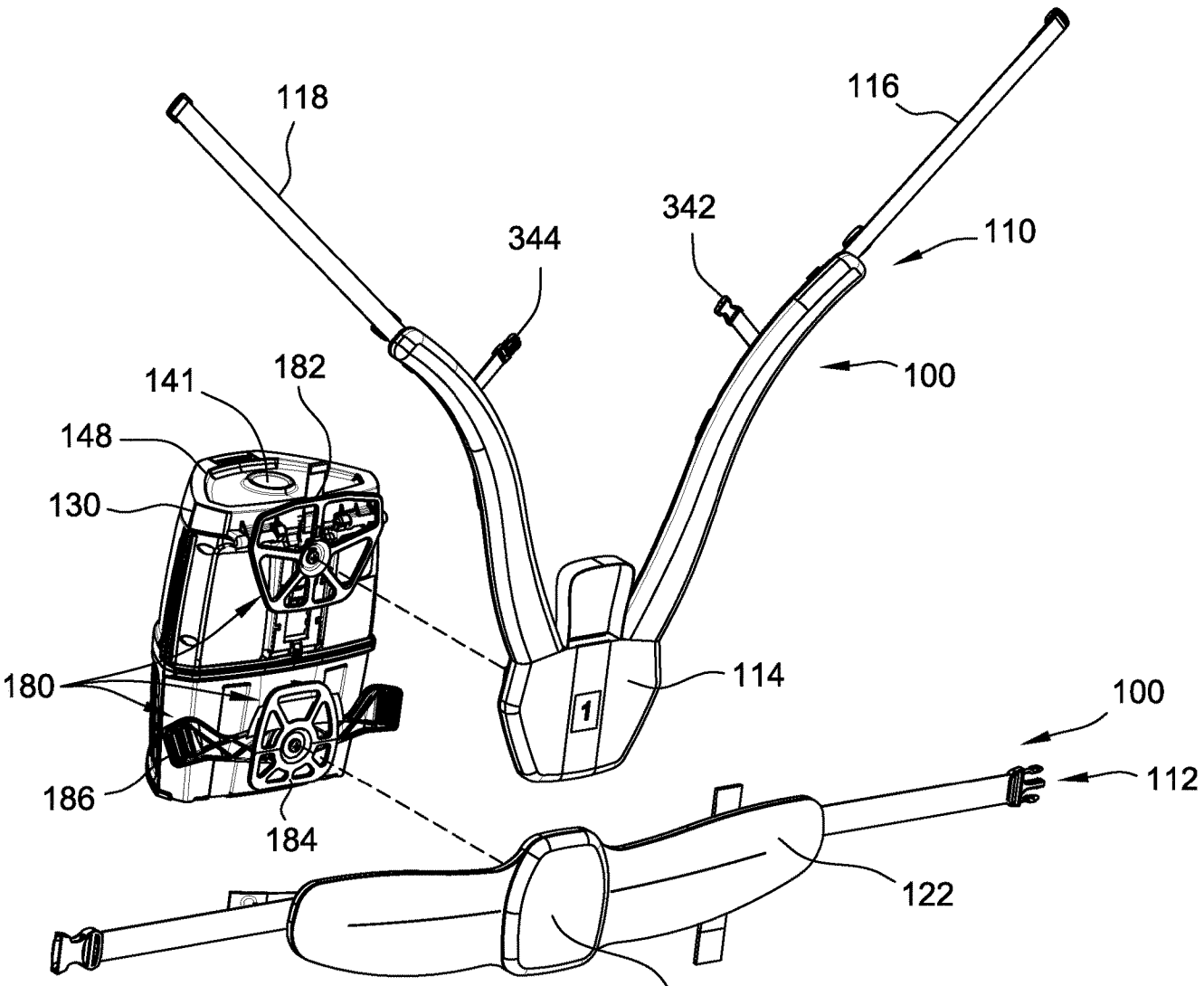
FIG. 4 is an exploded view of the electrical appliance shown in FIG. 1, illustrating the interchangeable harness assembly detached from the electrical appliance.
Figure 5:
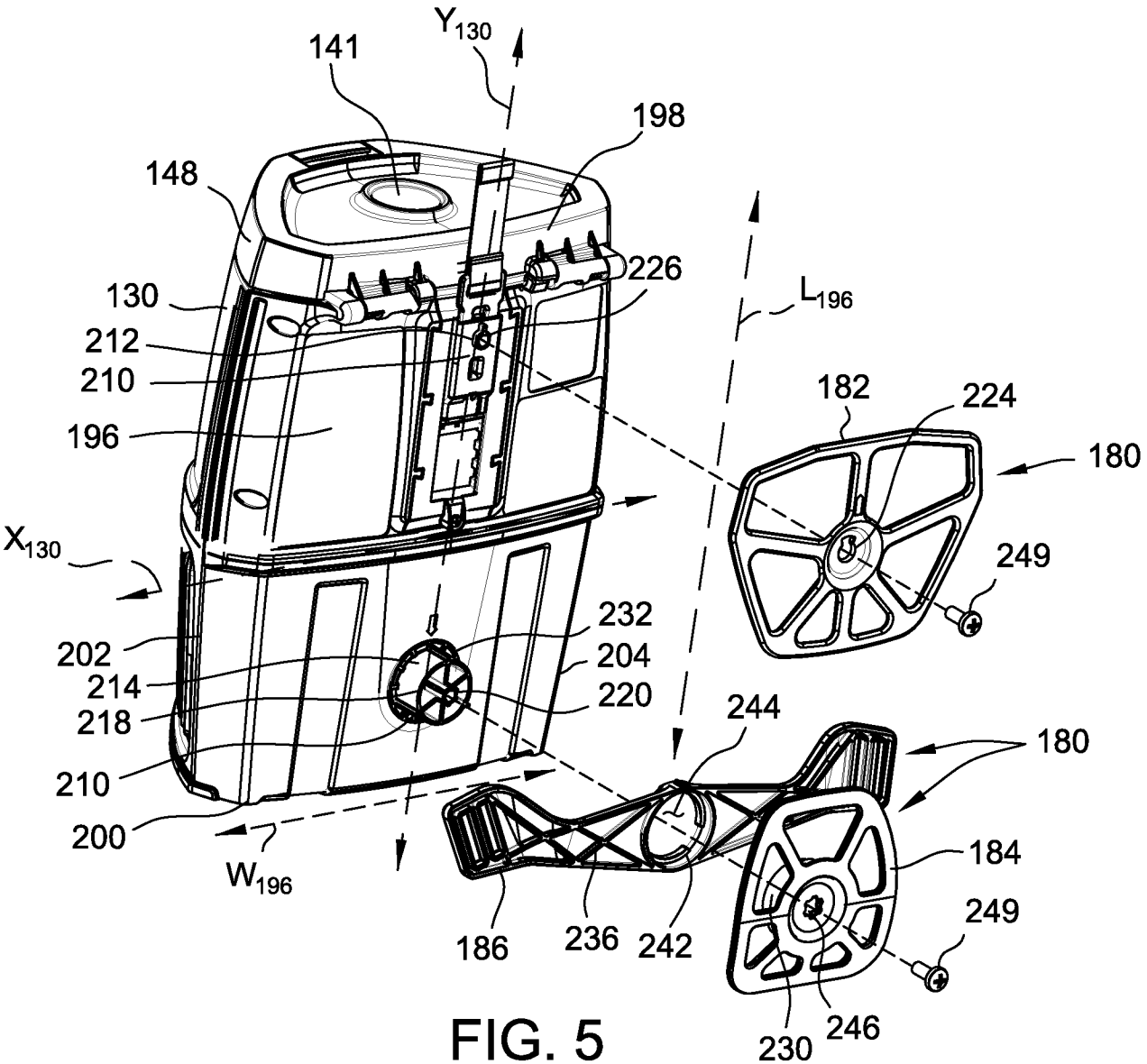
FIG. 5 is another exploded view of the electrical appliance shown in FIG. 1, illustrating an upper mounting plate, a lower mounting plate, and a lower shoulder strap mount detached from a housing of the electrical appliance.

FIG. 4 is an exploded view of the electrical appliance shown in FIG. 1, illustrating the harness assembly 100 detached from the electrical appliance 10. The electrical appliance 10 includes one or more mounting components 180 that are connected to the housing 130 to allow the harness assembly 100 to be selectively connected to the electrical appliance 10. In the illustrated embodiment, the electrical appliance 10 includes an upper mounting plate 182, a lower mounting plate 184, and a lower shoulder strap mount 186. Each of the upper mounting plate 182, the lower mounting plate 184, and the lower shoulder strap mount 186 is removably connected to the housing 130. In this illustrated embodiment, the upper mounting plate 182 supports the upper support assembly 110 and the lower mounting plate 184 supports the lower support assembly 112. In other embodiments, the electrical appliance 10 may have any suitable mounting components enabling the harness assembly 100 to be selectively connected to the electrical appliance 10. FIG. 5 shows the electrical appliance 10 having the upper mounting plate 182, the lower mounting plate 184, and the lower shoulder strap mount 186 detached from the housing 130.

The harness assembly 100 may be used with electrical appliances other than backpack vacuum cleaners, including but not limited to, backpack-style battery packs, backpack-style power supplies, wet/dry vacuum cleaners, blowers, sprayers, power tools, HVAC equipment, lighting and sound equipment, medical equipment, and heavy machinery. These other appliances may include suitable mounting components 180, such as the upper mounting plate 182, the lower mounting plate 184, and the lower shoulder strap mount 186, enabling the harness assembly 100 to be selectively connected to the appliance.

Referring to FIG. 5, the housing 130 includes rear wall 196 including an upper end 198 and a lower end 200, and a length $L_{196}$ extending between the upper end 198 and the lower end 200. When the harness assembly 100 is worn by the user and the electrical appliance 10 is supported by the harness assembly 100, the rear wall 196 is arranged adjacent to or proximate to the user's back. The upper end 198 of the rear wall 196 is arranged in proximity to the shoulders of a user. Likewise, the lower end 200 of the rear wall 196 is arranged in proximity to the user's lower back and/or waist.

The rear wall 196 includes a width $W_{196}$ extending between a first side 202 and a second side 204. When the electrical appliance 10 is supported by the harness assembly 100 worn by a user, the first side 202 and second sides 204 are arranged in proximity to a left and right sides of a user. The housing 130 includes a vertical axis $Y_{130}$ extending from the lower end 200 to the upper end 198 and a horizontal axis $X_{130}$ extending from the first side 202 to the second side 204. The vertical axis $Y_{130}$ is perpendicular to the horizontal axis $X_{130}$.

The upper mounting plate 182 and the lower mounting plate 184 are each removably connected to the rear wall 196 of the housing 130. In some embodiments, the upper mounting plate 182 is movably connected (e.g., slidable or translationally) to the housing 130 such that the upper mounting plate 182 may be selectively positioned at a selected location along the vertical axis $Y_{130}$ of the housing 130. For example, the upper mounting plate 182 may be mounted to a slide that is movably connected to a track connected to the rear wall 196.

The rear wall 196 of the housing 130 includes one or more attachment features 210 enabling the upper mounting plate 182 and the lower mounting plate 184 to be connected to the rear wall 196 of the housing 130. In the illustrated embodiment, the electrical appliance 10 includes an upper attachment 212 and a lower attachment 214. The upper attachment 212 and the lower attachment 214 may be connected to or formed integrally with the rear wall 196 of the housing 130. The upper attachment 212 may be arranged in proximity to upper end 198 of the rear wall 196. The lower attachment 214 may be arranged in proximity to the lower end 200 of the rear wall 196.

In the illustrated embodiment, the upper attachment 212 is a keyed shaft and the lower attachment 214 includes a first annular wall 218 and a lower fastener opening 220 (e.g., a threaded hole). Alternatively, and/or additionally, the upper attachment 212 and the lower attachment 214 may include any suitable mechanisms that enable the upper mounting plate 182 and the lower mounting plate 184 to be attached to the housing 130.

Figure 6:
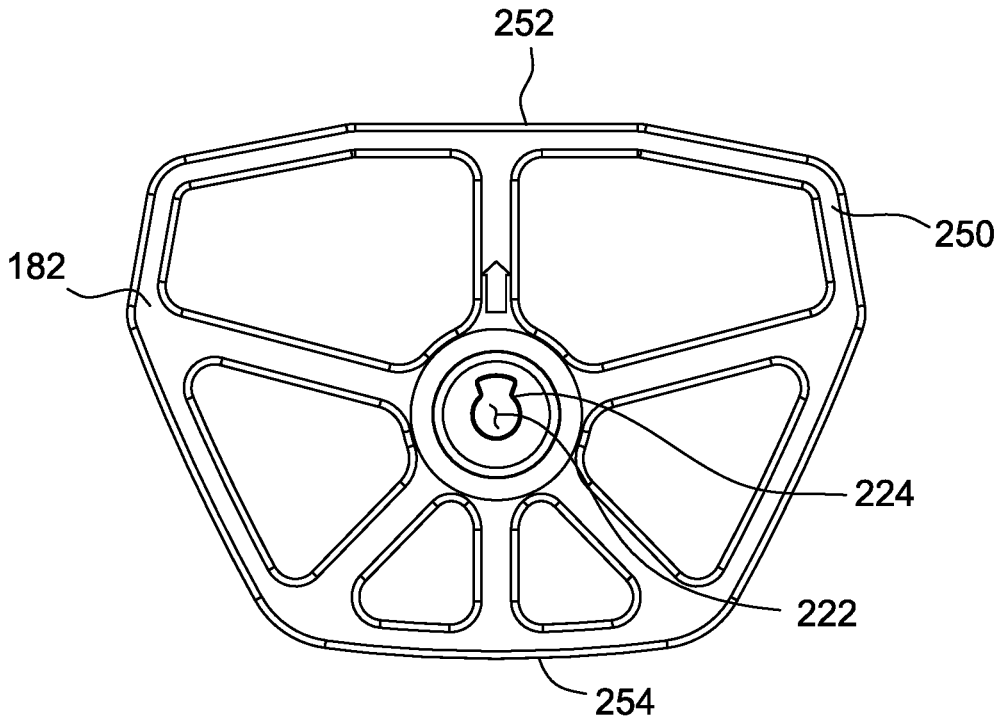
FIG. 6 is a rear view of the upper mounting plate shown in FIG. 5.
Figure 7:
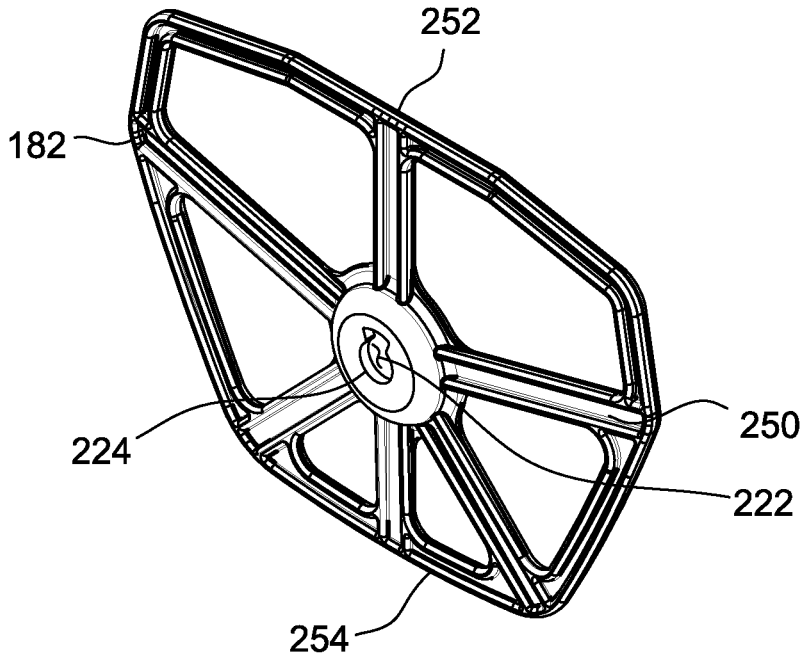
FIG. 7 is a front perspective view of the upper mounting plate shown in FIG. 5.

With additional reference to FIGS. 6 and 7, the upper mounting plate 182 includes a first keyed boundary 224 defining a first keyed bore 222. The first keyed boundary 224 is sized and shaped such that the first keyed bore 222 may receive the upper attachment 212 therein. For example, the upper attachment 212 may be a complimentary shape and size to the first keyed boundary 224 such that the upper attachment 212 may be inserted into the first keyed bore 222 defined by the first keyed boundary 224 to engage the upper mounting plate 182 and the housing 130. The first keyed boundary 224 and the upper attachment 212 includes one or more features that frictionally engages the upper mounting plate 182 to the housing 130. The electrical appliance 10 also includes a fastener 249 (e.g., a threaded screw) that may be inserted through the first keyed bore 222 and received within an upper fastener opening 226 defined on the upper attachment 212 (e.g., through the center of the keyed shaft).

In the illustrated embodiment, the lower mounting plate 184 is fixedly connected to the housing 130. In other embodiments, the lower mounting plate 184 can be movably connected to the housing 130. For example, the lower mounting plate 184 can be rotatably connected to the housing 130 such that the lower mounting plate 184 is rotatable about an axis that is generally perpendicular to the both the vertical axis $Y_{130}$ and horizontal axis $X_{130}$ of the housing 130. In yet other embodiments, the lower mounting plate 184 can be pivotably connected to the housing 130 such that the lower mounting plate 184 has multiple degrees of rotational freedom. The lower mounting plate 184 includes a second annular wall 230, that is sized and shaped such that the first annular wall 218 may be inserted within the second annular wall 230. The electrical appliance 10 includes one or more ridges 232 extending outward from the first annular wall 218. The lower mounting plate 134 may include one or more grooves or slots 234 that are sized and shaped to receive the ridges 232 extending from the first annular wall 218, when the lower mounting plate is connected to the housing 130.

The lower shoulder strap mount 186 is rotatably connected to at least one of the housing 130 and the lower mounting plate 184. Accordingly, the lower shoulder strap mount 186 is enabled to rotate independently from the lower mounting plate 184 and the housing 130. In the illustrated embodiment, the lower shoulder strap mount 186 is rotatably connected to the lower mounting plate 184 such that the lower shoulder strap mount 186 is enabled to rotate relative to the lower mounting plate 184 about an axis that is generally perpendicular to both the vertical $Y_{130}$ and horizontal axis $X_{130}$.

The lower shoulder strap mount 186 includes an elongate frame 236 extending from a first end 238 to a second end 240. The lower shoulder strap mount 186 includes a boundary 242 defining an opening 244. The opening 244 is arranged generally between the first end 238 and the second end 240. In the illustrated embodiment, the lower shoulder strap mount 186 is rotatably connected to lower mounting plate 184. Specifically, the boundary 242 is sized and shaped such that the opening 244 may receive at least a portion of the second annular wall 230 of the lower mounting plate 184. The second annular wall 230 is rotatably engaged with the boundary 242 of the opening 244. In some embodiments, the lower shoulder strap mount 186 is rotatably connected to the rear wall 196 of the housing 130.

In addition, the lower mounting plate 184 includes a second keyed boundary 246 defining a second keyed bore 248. A fastener 249 (e.g., a threaded screw) may be inserted through the second keyed bore 248 to be received within the lower fastener opening 220. The fastener 249, such as a threaded screw, may be tightened against the lower attachment 214 to secure the lower mounting plate 184 and the lower shoulder strap mount 186 to the lower attachment 214.

With additional reference to FIGS. 6 and 7, the upper mounting plate 182 includes an upper frame 250 that is generally planar in shape. In some embodiments, the upper frame 250 is generally trapezoidal in shape, having a top end 252 that is wider than a lower end 254 of the upper frame 250. The upper frame 250 defines the first keyed boundary 224 of the first keyed bore 222 extending through the upper frame 250.

Figure 8:
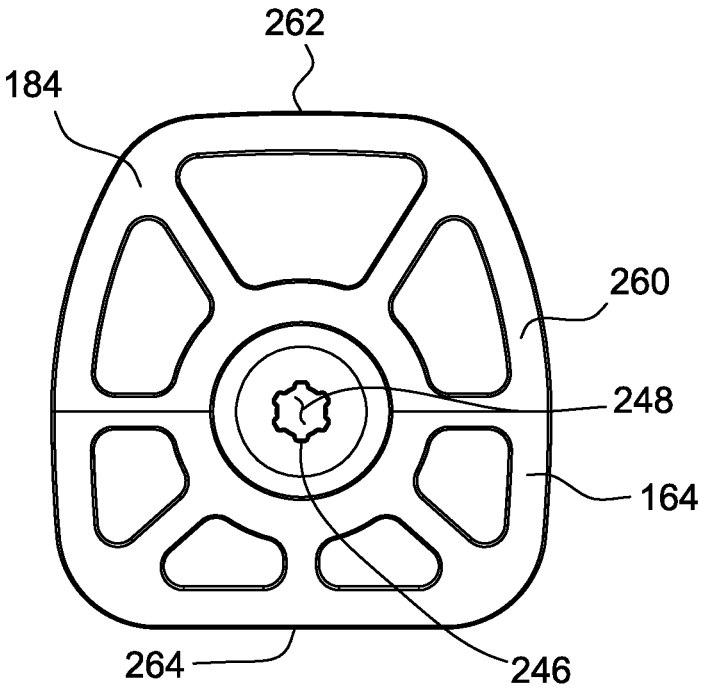
FIG. 8 is a rear perspective view of the lower mounting plate shown in FIG. 5.
Figure 9:
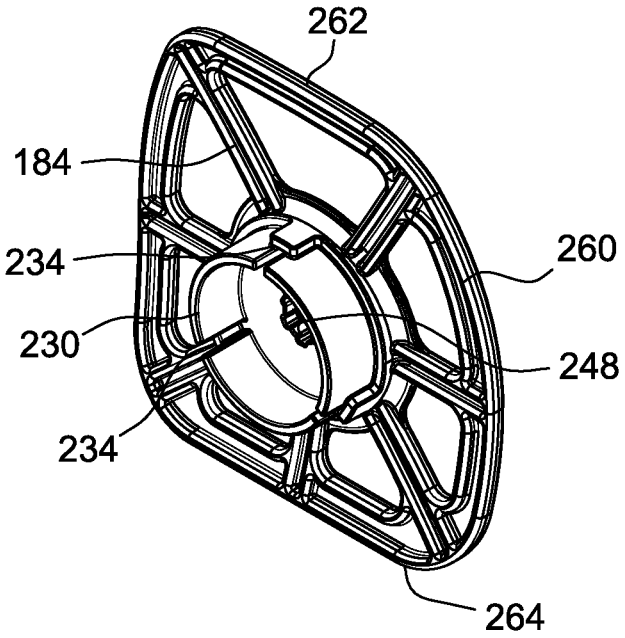
FIG. 9 is a front perspective view of the lower mounting plate shown in FIG. 5.

With additional reference to FIGS. 8 and 9, the lower mounting plate 184 includes a lower frame 260 that is generally planar in shape. The lower mounting plate 184 includes the second annular wall 230 extending generally perpendicularly from the lower frame 260. The lower frame 260 may be trapezoidal in shape, having a top end 262 that is larger than the lower end 264. The lower mounting plate 184 defines the second keyed boundary 246 defining the second keyed bore 248 extending through the lower frame 260.

Figure 10:
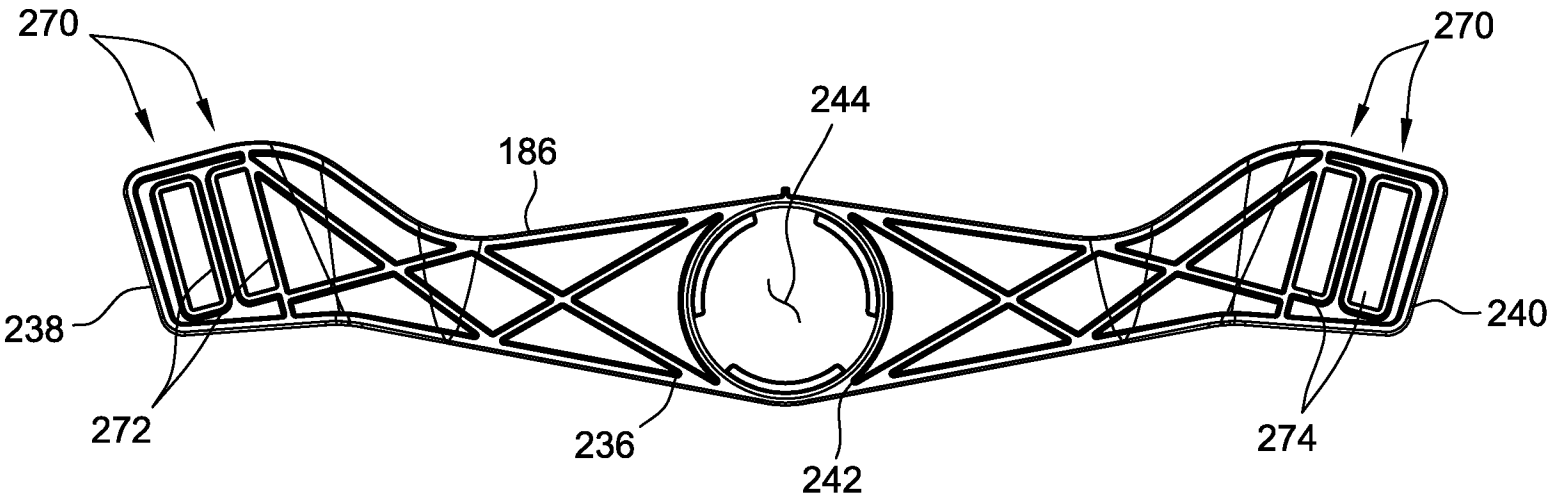
FIG. 10 is a rear view of the lower shoulder strap mount shown in FIG. 5.
Figure 11:
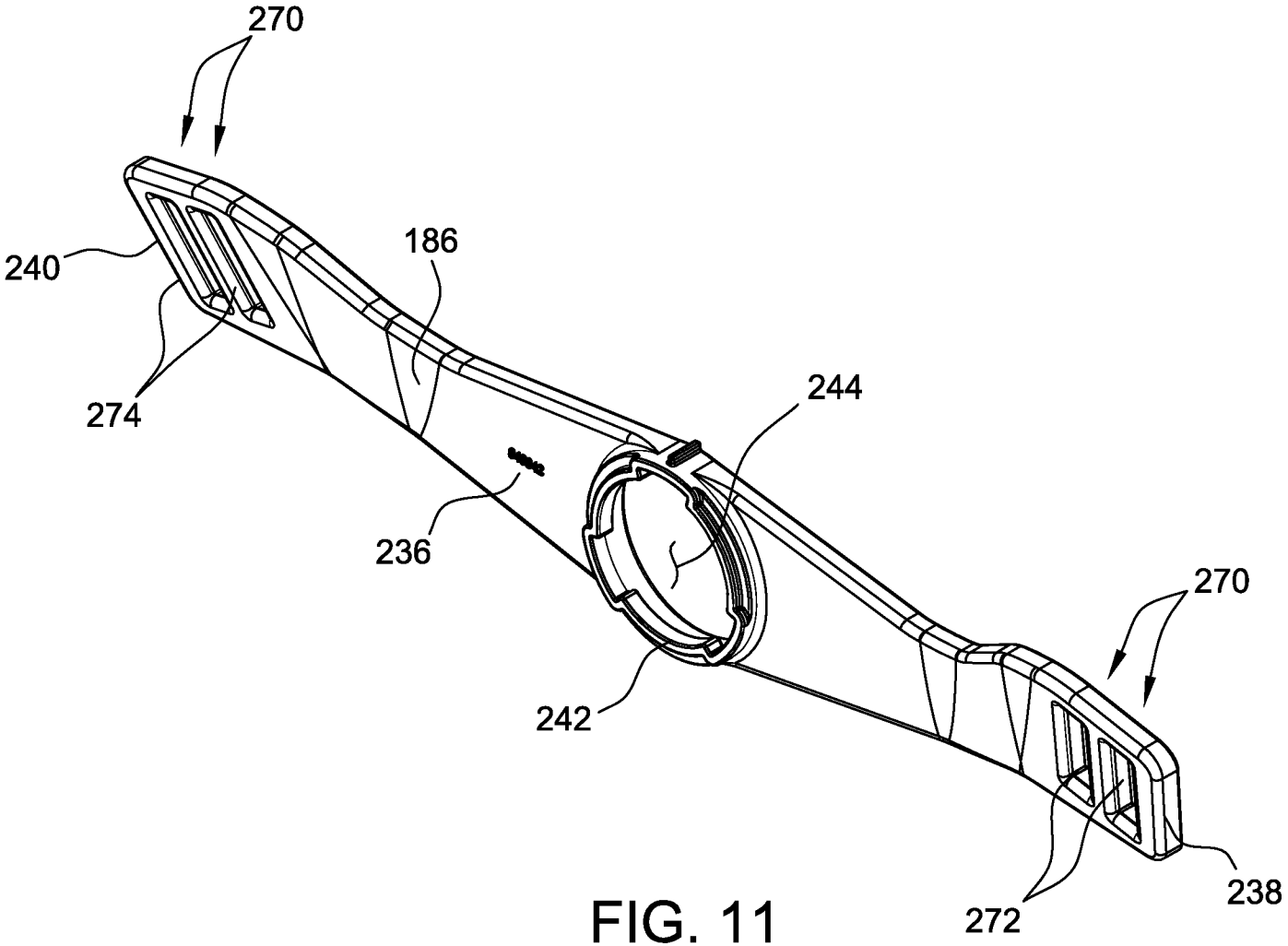
FIG. 11 is a front view of the lower shoulder strap mount shown in FIG. 5.

With additional reference to FIGS. 10 and 11, the lower shoulder strap mount 186 includes a plurality of slots 270 formed on the elongate frame 236 to facilitate selective engagement between the first shoulder strap 116 and the second shoulder strap 118 and the lower shoulder strap mount 186. In the illustrated embodiment, the lower shoulder strap mount 186 includes a first pair of slots 272 arranged in proximity to the first end 238 of the elongate frame 236 and a second pair of slots 274 arranged in proximity to the second end 240 of the elongate frame 236. The first pair of slots 272 are sized and shaped to receive at least a portion of the first shoulder strap 116. The second pair of slots 274 are sized and shaped to receive at least a portion of the second shoulder strap 118. The first pair of slots 272 and second pair of slots 274 are substantially similar.

In some embodiments, the upper mounting plate 182 and the lower mounting plate 184 are substantially similar in shape and size. In some embodiments, the upper mounting plate 182, the lower mounting plate 184, and the lower shoulder strap mount 186 are composed of a hardened or rigid plastic. For example, the upper mounting plate 182, the lower mounting plate 184, and the lower shoulder strap mount 186 may be formed of an injection molded plastic.

The lower shoulder strap mount 186 and the upper mounting plate 182 are connected to the upper support assembly 110. Specifically, the upper mounting plate 182 may be connected to the upper back pad 114, and the first shoulder strap 116 and the second shoulder strap 118 may be connected to the lower shoulder strap mount 186. The lower mounting plate 184 supports the lower support assembly 112. Specifically, the lower mounting plate 184 may be connected to the lower back pad 120. The independent rotational freedom of the lower mounting plate 184 and the lower shoulder strap mount 186 enables a user wearing the harness assembly 100 to move about with limited restriction. For example, the independent rotational freedom of the lower shoulder strap mount 186, which is connected to the first shoulder strap 116 and the second shoulder strap 118, allows the user to bend over, lean to the side, and extend their arms, independently of the lower support assembly 112.

Figure 12:
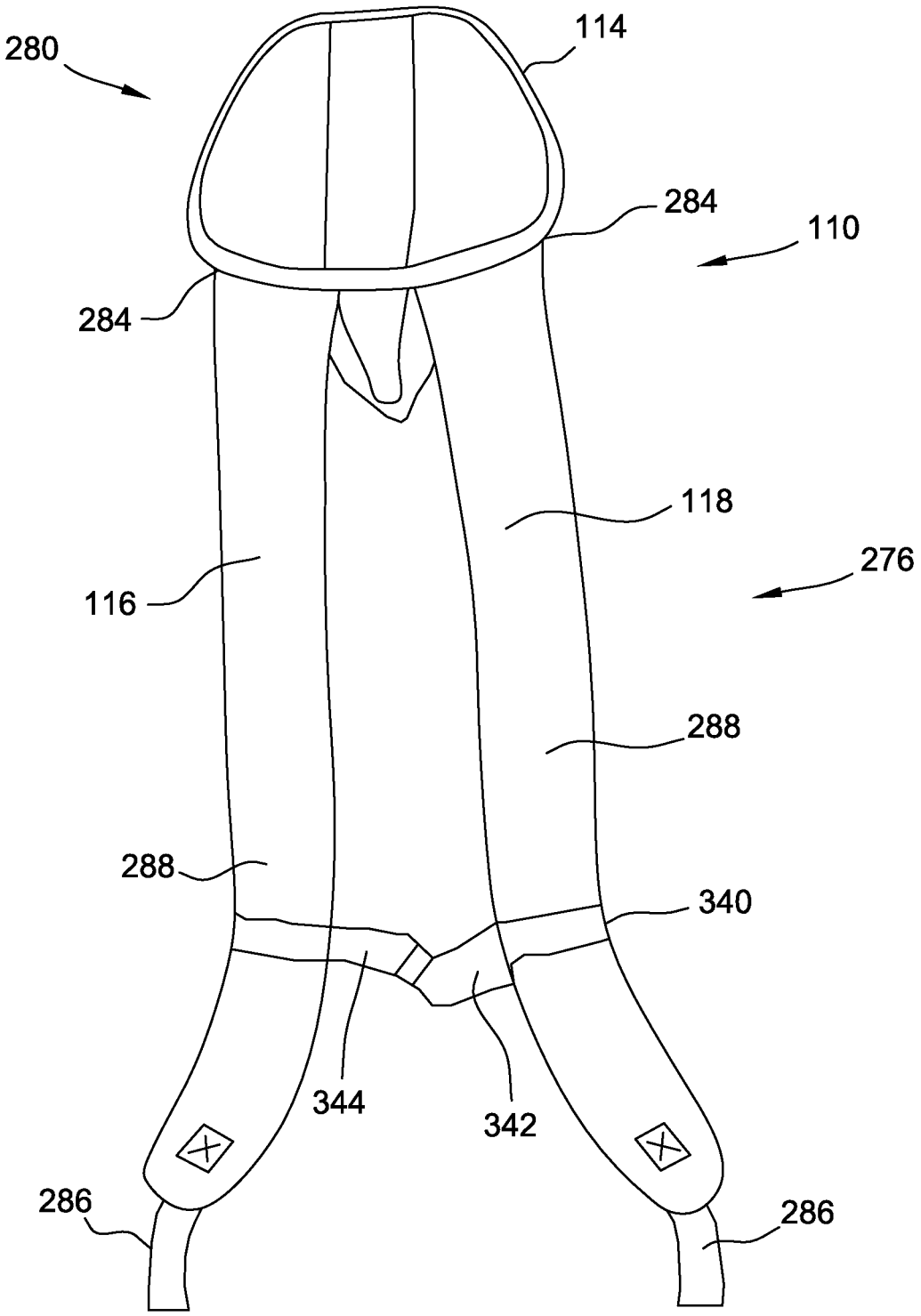
FIG. 12 is a plan view of an upper support assembly of the harness assembly shown in FIGS. 1 and 2, showing a first side of the upper support assembly that engages a user when worn.
Figure 13:
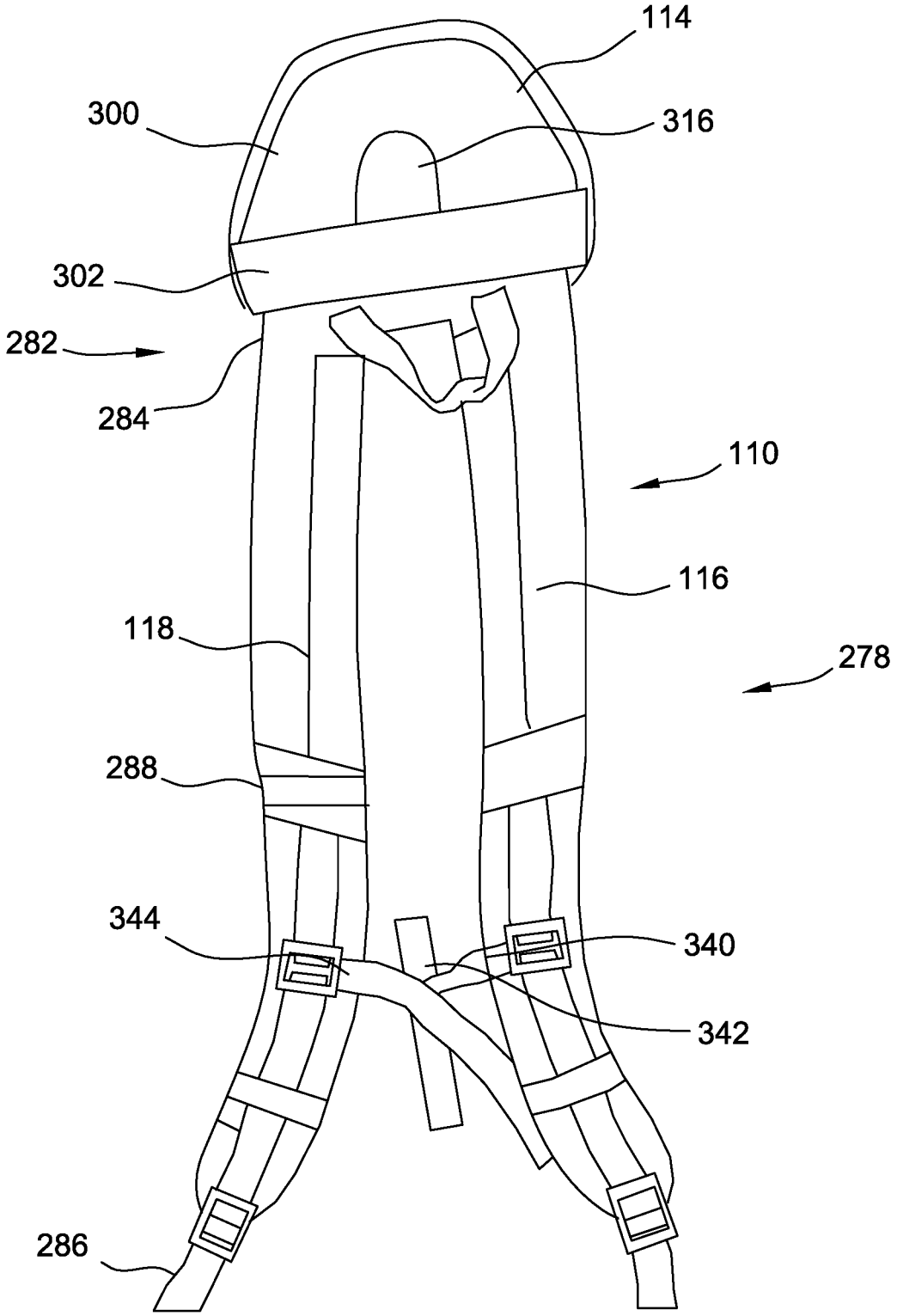
FIG. 13 is a plan view of the upper support assembly shown in FIG. 12, showing a second side of the upper support assembly opposite the first side.
Figure 14:
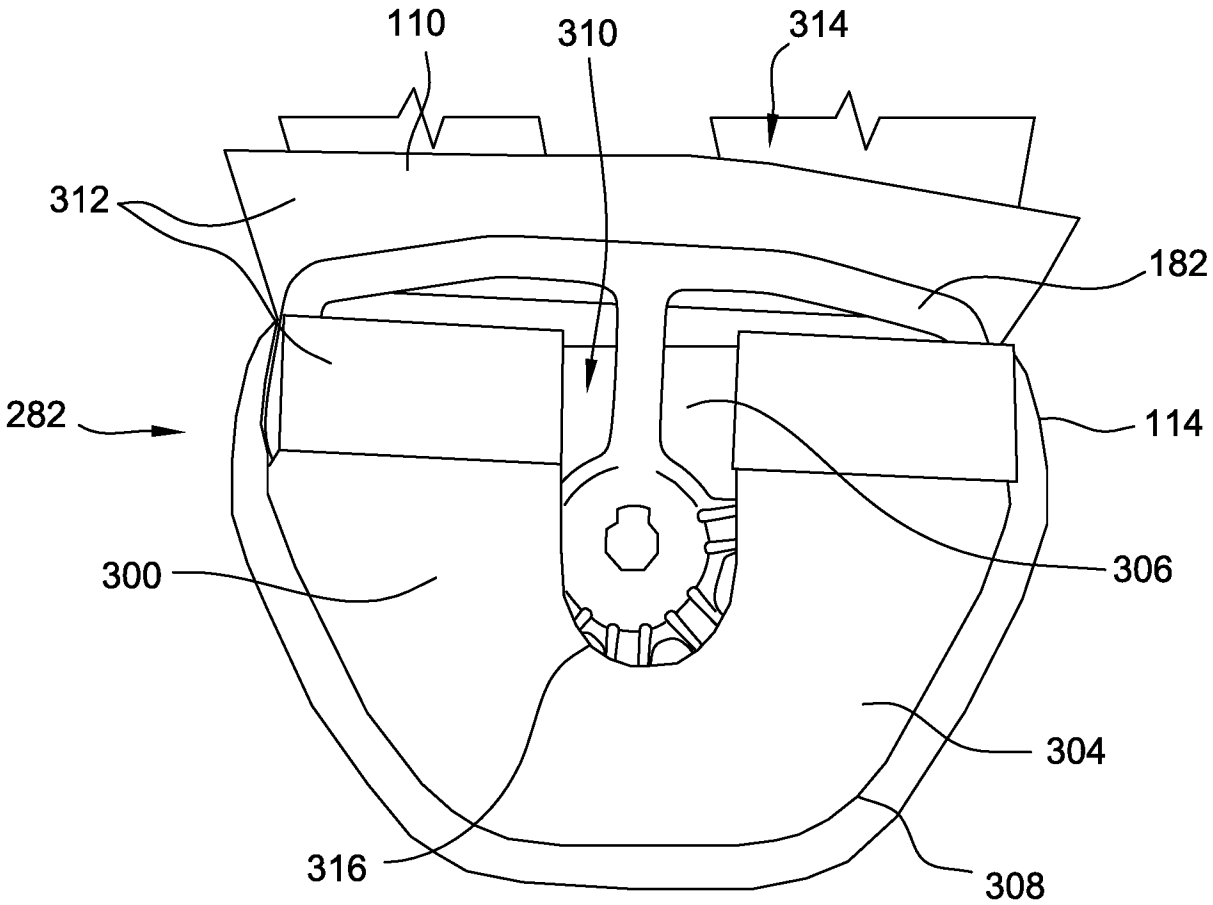
FIG. 14 is a rear view of the upper support assembly shown in FIGS. 12 and 13, illustrating the upper mounting plate connected thereto.

FIGS. 12-14 illustrate the upper support assembly 110 detached from the electrical appliance 10. The upper support assembly 110 includes a first side 276 and an opposing second side 278. The first side 276 of the upper support assembly 110 engages a user wearing the harness 100. For example, the first side 276 of the upper back pad 114 may engage a back of the user and the first side 276 of the first shoulder strap 116 and the second shoulder strap 118 can engage a chest of the user. FIG. 12 illustrates the first side 276 of the upper support assembly 110 and FIG. 13 illustrates the opposing second side 278. The first shoulder strap 116 and the second shoulder strap 118 extend from the upper back pad 114. The upper back pad 114 includes a first side 280 (FIG. 12) and an opposing second side 282 (FIG. 13). When the harness assembly 100 is worn by a user, the first side 280 faces and/or engages the user's back, and the first shoulder strap 116 and the second shoulder strap 118 extend over the user's shoulders.

Each of the first shoulder strap 116 and the second shoulder strap 118 includes a first end 284, a second end 286, and an elongate body 288 extending between the first end 284 and the second end 286. In this embodiment, the first shoulder strap 116 and the second shoulder strap 118 are substantially identical. In some embodiments, the first shoulder strap 116 is a mirror image of the second shoulder strap 118. During use of the harness assembly 100, the first ends 284 of the first and second shoulder straps 116, 118 are arranged in proximity to the shoulders of a user wearing the harness assembly 100, and the second ends 286 of the first and second shoulder straps 116, 118 are arranged in proximity to the waist of the user. When the harness assembly 100 is worn, the first shoulder strap 116 and the second shoulder straps 118 are arranged generally parallel to each other along the chest of the user.

The second ends 286 of the first shoulder strap 116 and the second shoulder strap 118 may be selectively engaged with the lower shoulder strap mount 186. For example, the second ends 286 may include a buckle, strap, and/or any other suitable component that enables the first shoulder strap 116 and the second shoulder strap 118 to be selectively engaged with the lower shoulder strap mount 186. In the illustrated embodiment, the second end 286 is a strap (e.g., a nylon strap) that is be passed through one or more of the plurality of slots 270 formed on the lower shoulder strap mount 186. In other embodiments, the lower shoulder strap mount 186 and the second ends 286 of the first shoulder strap 116 and the second shoulder strap 118 include any suitable mechanisms enabling the first shoulder strap 116 and the second shoulder strap 118 to be tightened and/or loosened (e.g., a length of the first and second shoulder straps 116, 118 extending between the upper back pad 114 and the lower shoulder strap mount 186 may be selectively increased or decreased) in order to accommodate the height and weight of a user wearing the harness assembly 100.

Figure 15:
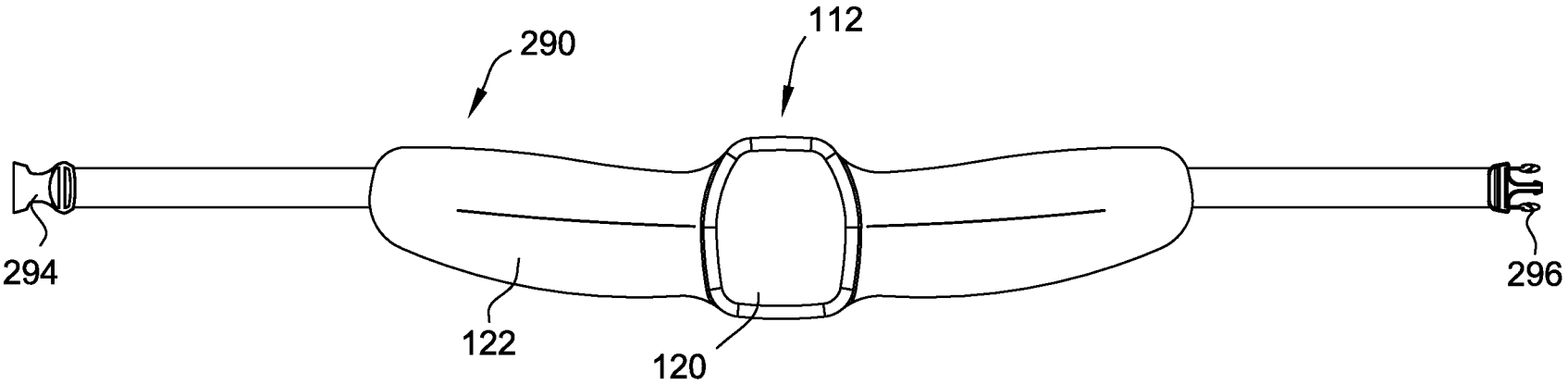
FIG. 15 is plan view of a lower support assembly of the harness assembly shown in FIGS. 1 and 2, showing a first side that engages a user when worn.
Figure 16:
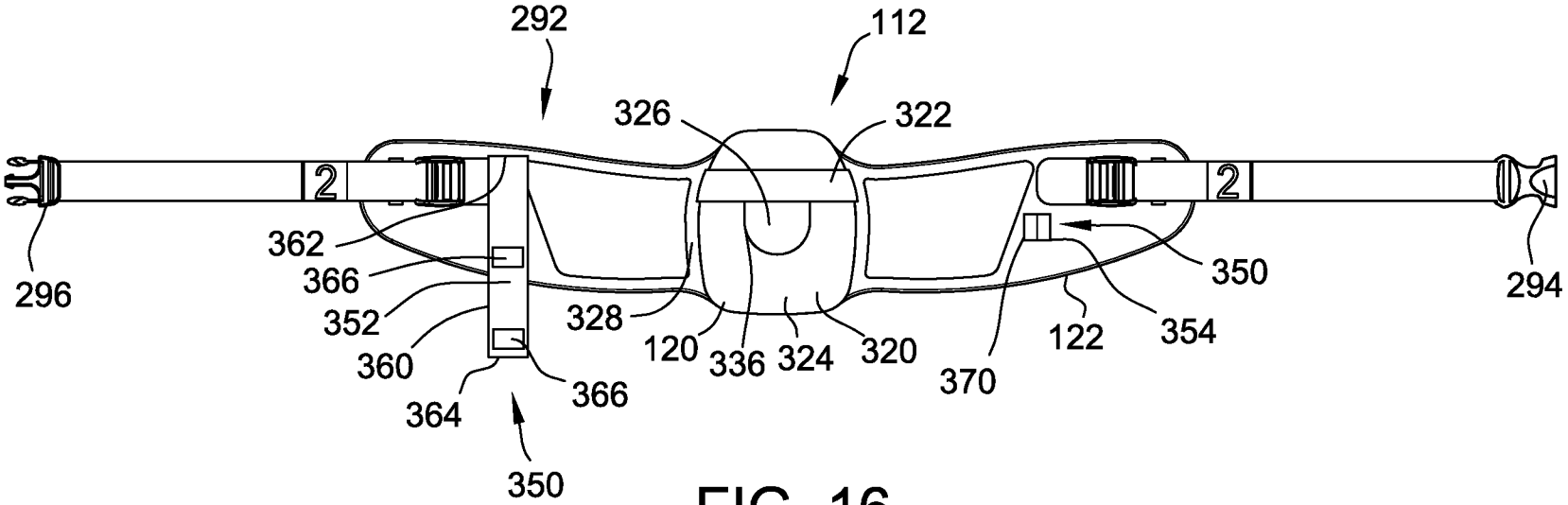
FIG. 16 is a plan view of the lower support assembly shown in FIG. 15 showing a second side of the lower support assembly opposite the first side.

With additional reference to FIGS. 15 and 16, the lower support assembly 112 includes the lower back pad 120 and the waist belt 122 emanating from the lower back pad 120. In some embodiments, the lower back pad 120 and the waist belt 122 are formed integrally, and in other embodiments, the lower back pad 120 and the waist belt 122 are formed separately and connected together. The lower back pad 120 includes a first side 290 (FIG. 15) and an opposing second side 292 (FIG. 16). The first side 290 faces and/or engages a user's back when the harness assembly 100 is worn by the user. For example, the first side 290 engages the user's lower back and/or waist. The waist belt 122 includes a first waist end 294 and a second waist end 296 each including suitable mechanisms enabling the first waist end 294 to be selectively connected to the second waist end 296. For example, the first waist end 294 and the second waist end 296 may include opposing buckles, snaps, quick release components, or other suitable fasteners that enable the first end 294 and the second waist end 296 to be wrapped around a user's waist and connected to one another.

With additional reference to FIGS. 13 and 14, the upper back pad 114 includes an upper pocket 300 located on the second side 282 of the upper back pad 114, and an upper flap 302. The upper pocket 300 is sized and shaped to receive the upper mounting plate 182 therein, as shown in FIG. 14. The upper flap 302 is selectively engageable or connectable with the upper pocket 300 to close or occlude an upper opening 310 of the upper pocket 300 to facilitate retention of the upper mounting plate 182 within the upper pocket 300. The upper pocket 300 includes a front cover 304 and a back cover 306. The front and back covers 304, 306 at least partially define a boundary 308 of the upper pocket 300. The front and back covers 304, 306 may be connected together along a portion of the boundary 308 of the front and back covers 304, 306. At least a portion of the boundary 308 between the front and back covers 304, 306 is not connected together, defining the upper opening 310 leading into to the upper pocket 300.

The upper flap 302 may be selectively extended over the upper opening 310. For example, the upper flap 302 may be attached to the back cover 306 and selectively attached to the front cover 304. The upper flap 302 and the upper pocket 300 may include any suitable first and second attachment features enabling the upper flap 302 to be selectively attached and/or detached from the upper pocket 300 without the use of tools or machinery. In the illustrated embodiment, the upper flap 302 and the upper pocket 300 includes hook and loop fasteners 312. Additionally, or alternatively, the first and second attachment features may include, for example and without limitation, buckles, snaps, buttons, magnets, and combinations thereof.

In some embodiments, the upper back pad 114 includes a first auxiliary pocket 314 located on the upper flap 302. The first auxiliary pocket 314 is sized and shaped to receive one or more fingers of a user's hand therein to facilitate tightening the upper flap 302 around the upper mounting plate 182 and connecting the upper flap 302 to the front cover 304. The front cover 304 may define an upper aperture 316, through which the fastener 249 connecting the upper mounting plate 182 to the electrical appliance 10 extends when the upper back pad 114 is connected to the upper mounting plate 182.

Figure 17:
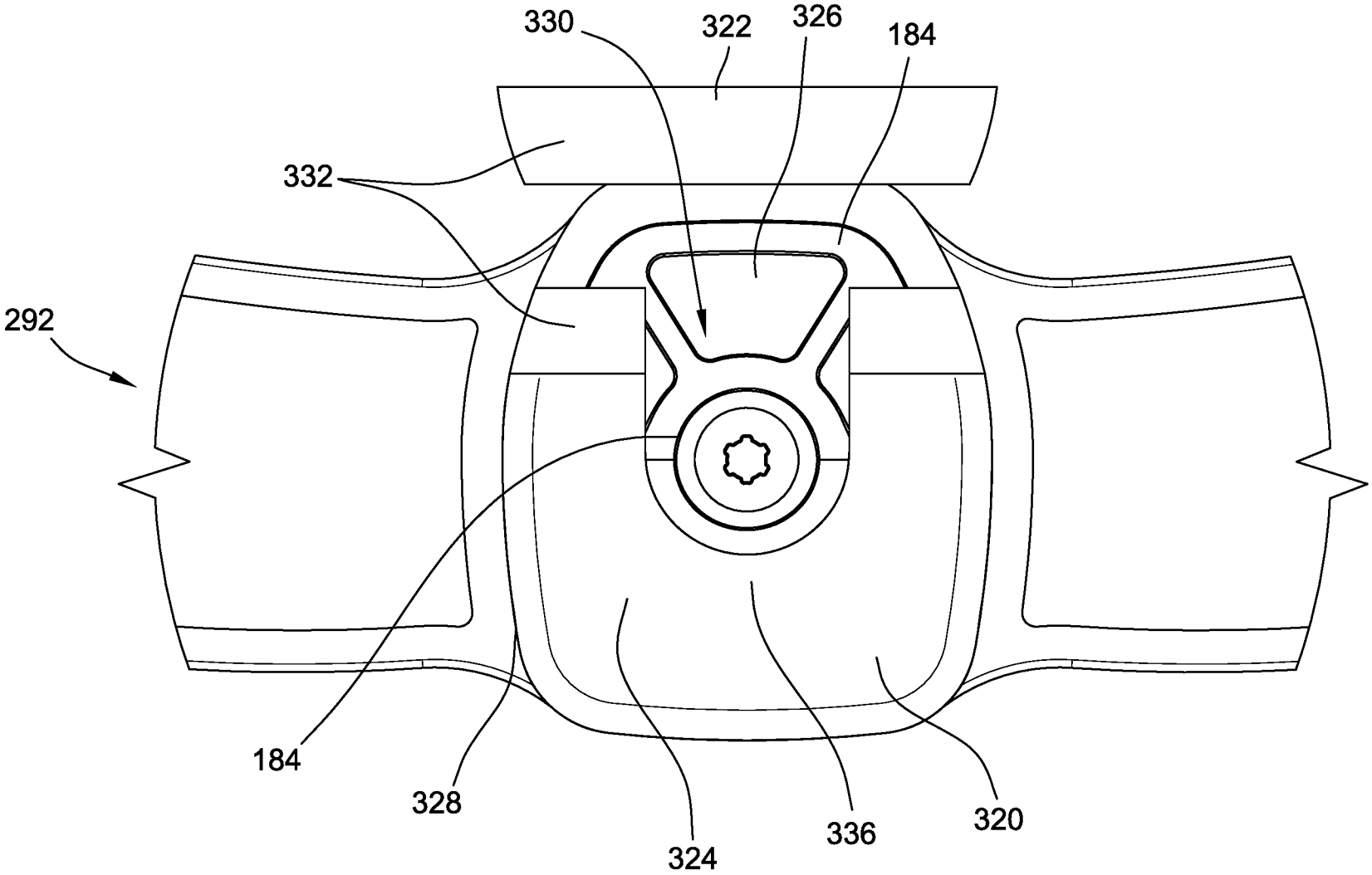
FIG. 17 is a rear view of the lower support assembly shown in FIGS. 15 and 16, illustrating the lower mounting plate connected thereto.

With additional reference to FIGS. 16 and 17, the lower back pad 120 includes a lower pocket 320 and a lower flap 322. The lower pocket 320 is located on the second side 292 of the lower back pad 120. The lower pocket 320 is sized and shaped to receive the lower mounting plate 184 therein. The lower flap 322 is selectively engageable with or connectable to the lower pocket 320 to close or occlude a lower opening 330 of the lower pocket 320 to facilitate retaining the lower mounting plate 184 within the lower pocket 320. The lower pocket 320 includes a front cover 324 and a back cover 326. The front and back covers 324, 326 at least partially define a boundary 328 of the lower pocket 320. The front and back covers 324, 326 may be connected together along a portion of the boundary 328 of the front and back covers 324, 326. At least a portion of the boundary 328 between the front and back covers 324, 326 is not connected together, defining the lower opening 330 leading into the lower pocket 320.

The lower flap 322 may be selectively extended over the lower opening 330. For example, the lower flap 322 may be attached to the back cover 326 and selectively attached to the front cover 324. The lower flap 322 and the lower pocket 320 may include any suitable first and second attachment features enabling the lower flap 322 to be selectively attached and/or detached from the lower pocket 320 without the use of tools or machinery. In the illustrative embodiment, the lower flap 322 and the lower pocket 320 includes hook and loop fasteners 332. Additionally, or alternatively, the first and second attachment features may include, for example and without limitation, buckles, snaps, buttons, magnets, and combinations thereof.

Figure 18:
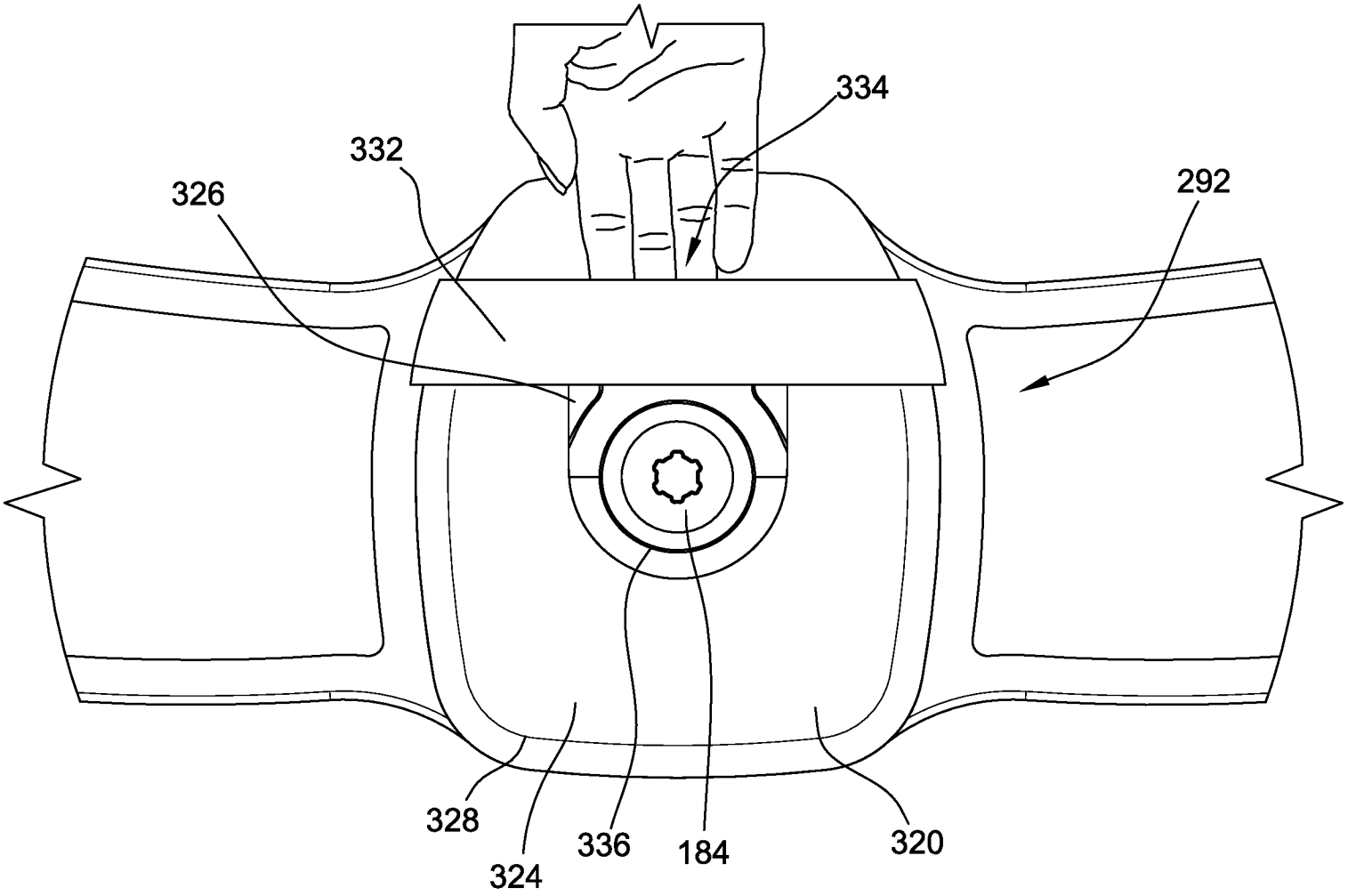
FIG. 18 is a rear view of the lower support assembly showing an auxiliary pocket.

In some embodiments, the lower back pad 120 includes a second auxiliary pocket 334 located on the lower flap 322, as shown in FIG. 18. The second auxiliary pocket 334 is sized and shaped to receive one or more fingers of a user's hand therein to facilitate tightening the lower flap 322 around the lower mounting plate 184 and connecting the lower flap 322 to the front cover 324. The front cover 324 may define a lower aperture 336, through which the second annular wall 230 and the fastener 249 connecting the lower mounting plate 184 to the electrical appliance 10 extend when the lower back pad 120 is connected to the lower mounting plate 184.

The first and second auxiliary pockets 314, 334 includes a shallow pocket, extending partially along a depth of the upper pocket 300 and lower pocket 320. As shown in FIG. 18, the first and second auxiliary pockets 314, 334 allows the user to access the first and second attachment features of the upper pocket 300 and the lower pocket 320. In the illustrated embodiment, the first and second attachment features includes the hook and loop fastener 312, 332. For example, a user may reach into the first auxiliary pockets 314 in order to press together the hook and loop fasteners 321 to engage the upper flap 302 with the upper pocket 300. Likewise, a user may reach into the second auxiliary pocket 334 in order to press together the hook and loop fasteners 321 to engage the lower flap 322 with the lower pocket 320. In some embodiments, the first and second auxiliary pockets 314, 334 allows the user to access at least a portion of the upper mounting plate 182 and the lower mounting plate 184 contained within the upper pocket 300 and lower pocket 320. For example, the user may reach into the first and/or second auxiliary pocket 314, 334 to adjust the position of the upper mounting plate 182 and lower mounting plate 184 retained therein.

Referring again to FIGS. 12 and 13, in the illustrated embodiment, the upper support assembly 110 includes a chest strap assembly 340 including a first chest strap 342 and second chest strap 344, each extending generally perpendicularly from the first shoulder strap 116 and the second shoulder strap 118. The first chest strap 342 and the second chest strap 344 each include a suitable coupling mechanism that enables the first chest strap 342 and second chest strap 344 to be connected to one another. The chest strap assembly 340 also includes an adjustable mechanism that enables a length of the chest strap assembly 340 to be adjusted. In other example embodiments, the harness assembly 100 may not include a chest strap assembly 340.

In some embodiments, the harness assembly 100 can include one or more accessory couplers 350 (FIG. 16) for securing accessories to the harness assembly 100. The accessory couplers 350 may be connected to the harness assembly 100, for example, to at least one of the first shoulder strap 116, the second shoulder strap 118, and/or the lower support assembly 112. The accessory couplers 350 can be connected to harness assembly 100 using any suitable connection or attachment means. In some embodiments, the accessory couplers 350 can be connected to the harness assembly 100 using suitable fasteners, e.g., hook and loop fasteners, zippers, and/or clasps, enabling the accessory coupler 350 to be removably connected to the harness assembly 100. In other embodiments, one or more accessory couplers 350 can be non-removably connected to the harness assembly 100 (e.g., sewn). The accessory couplers 350 can be used to connect or attach various accessories to the harness assembly 100, including, for example and without limitation, the power cord restraint assembly 140, vacuum attachments (e.g., nozzles, wands, hoses, brushes), batteries or battery packs, brushes, tools, and any other accessory for use with appliance 10.

With reference to FIG. 16, the illustrated embodiment includes two accessory couplers 350—a first accessory coupler 352 and a second accessory coupler 354. The first accessory coupler 352 and the second accessory coupler 354 are connected to the waist belt 122 in the illustrated embodiment, although the first and second accessory couplers 352 and 354 can be connected to other portions of the harness assembly 100.

In the illustrated embodiment, the first accessory coupler 352 includes a strap 360 extending from a first end 362 connected to the waist belt 122 to a second, free end 364. The strap 360 includes suitable fasteners 366 that allow the second end 364 of the strap to be attached to a portion of the strap 360, for example, between the first end 362 and the second end 364. In some embodiments, for example, the strap 360 includes hook and loop fasteners 366 located at the second end 364 and at a position on the strap 360 between the first end 362 and the second end 364. The strap 360 can be used to secure an accessory to the harness assembly 100, for example, by routing or wrapping the strap 360 around and/or through one or more slots defined in the accessory, and then connecting the fastener 366 at the second end 364 to the fastener 366 located along the length of the strap 360. In some embodiments, the first accessory coupler 352 is used to secure the power cord restraint assembly 140 to the harness 100. Specifically, the power cord restraint assembly 140 includes one or more slots formed thereon and the free end 364 of the strap 360 may be routed through the slots and then the free end 364 may be connected to the strap 360 using a hook and loop fastener, securing the power cord restraint assembly 140 to the first accessory coupler 352.

The second accessory coupler 354 includes an elastic loop 370 connected to the waist belt 122. The elastic loop 370 has a suitable elastic construction that allows the loop 370 to be stretched or expanded around an accessory, and then constrict around the accessory to secure the accessory to the harness assembly 100. In other embodiments, the accessory couplers 350 may include a pocket, a sheath, an opening, or other suitable components enabling an accessory to be removably connected to the harness 100.

The upper support assembly 110 and the lower support assembly 112 assist in distributing the weight of the electrical appliance 10 across the upper back, shoulders, and waist of a user while wearing the harness assembly 100. The upper support assembly 110 and the lower support assembly 112 include one or more of a cushion and/or padding to provide comfort and support to a user wearing the harness assembly 100. In addition, the harness assembly 100 may be constructed of or include layers of materials that provide comfort to the user, e.g., the material may include a wicking fabric that moves sweat and moisture to the outer surface of the fabric to be evaporated. The material may also include breathable materials that provide ventilation to the harness assembly 100 during wear. For example, the harness assembly 100 may be constructed of or include one or more porous layers (e.g., foams and/or meshes) allowing warm or hot air and/or moisture to escape from the fabric while drawing in cooler air from the environment.

In the illustrated embodiment, the upper support assembly 110 and the lower support assembly 112 are constructed of a plurality of material layers. The lower support assembly 112 includes a mesh layer, a closed-cell foam with a plurality of openings allowing the passage of air, a layer of an open-celled foam and a three-dimensional mesh layer. The upper support assembly 110 is constructed of a plurality of material layers including a nylon layer, a closed-cell perforated foam layer, a mesh layer, and a three-dimensional mesh layer. In some embodiments, the plurality of material layers may extend over a portion of the upper support assembly 110 and the lower support assembly 112. For example, the first shoulder strap 116 and the second shoulder strap 118 may include multiple material layers in proximity to the shoulders of the user wearing the harness assembly 100 while a lower portion of the straps 116, 118, near the user's waist may be composed of fewer material layers. In other example embodiments, the upper support assembly 110 and the lower support assembly 112 include any number of suitable material layers that provide comfort to the user. In addition, material layers may be selected for their durability and strength.

Figure 19:
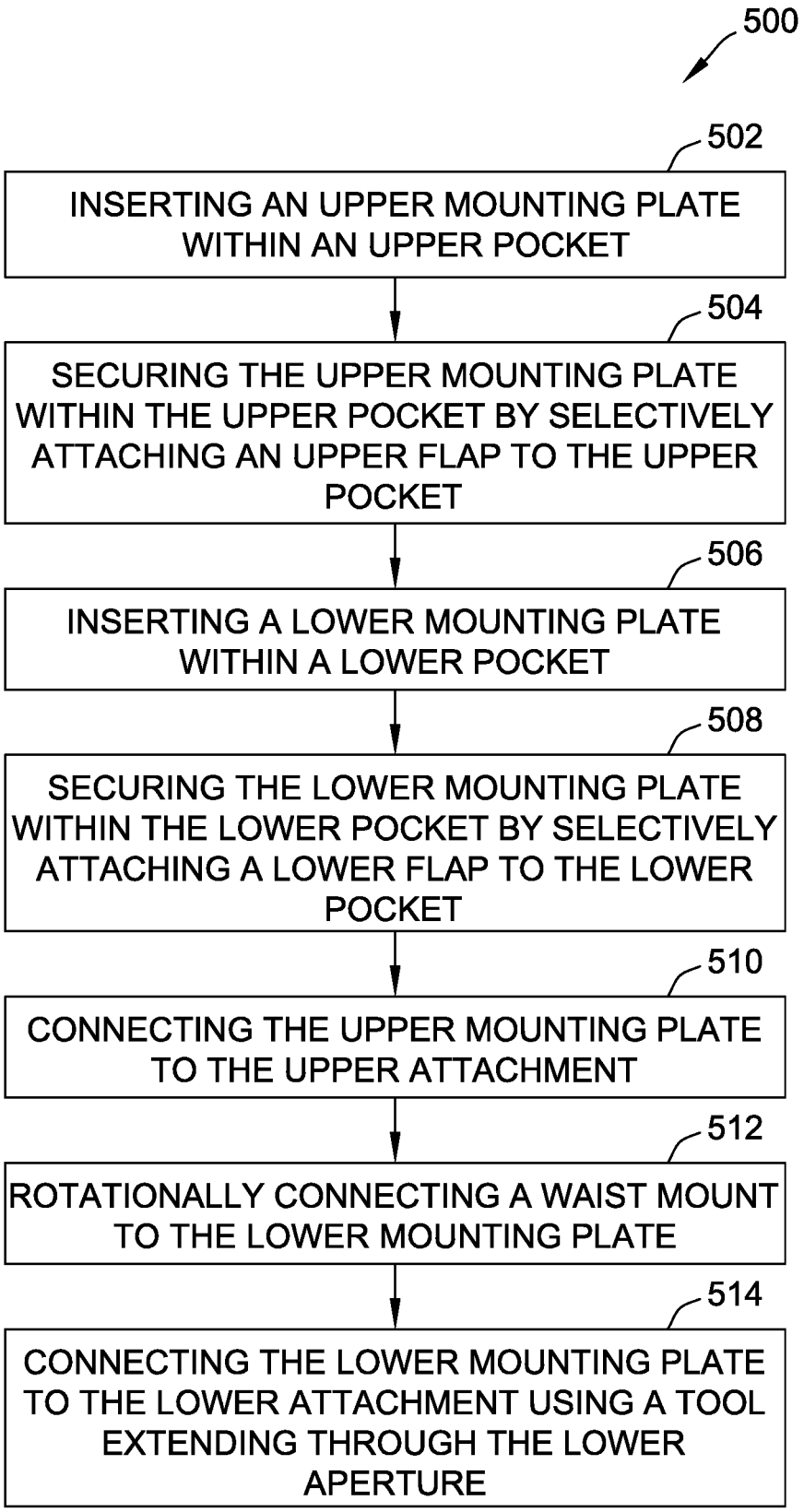
FIG. 19 is a flow diagram of an example method of assembling the vacuum cleaner assembly and the interchangeable harness assembly shown in FIGS. 1 and 2.

FIG. 19 is a flow diagram of an example method 500 of assembling the interchangeable harness assembly 100 and the electrical appliance 10. The method 500 of assembly may occur during manufacture or initial assembly (e.g., prior to the harness assembly 100 and electrical appliance 10 being sent to a consumer for use). Once the harness assembly 100 and the electrical appliance 10 has reached an end user, the end user may selectively connect/disconnect the upper support assembly 110 and the lower support assembly 112 from the upper mounting plate 182, the lower mounting plate 184, and the lower shoulder strap mount 186, as described in detail above. For example, the upper flap 302 and the lower flap 322 may be detached from the upper pocket 300 and lower pocket 320, to remove the upper mounting plate 182 and the lower mounting plate 184 that are retained therein, without requiring the user to utilize tools and/or machinery. Additionally, or alternatively, steps of method 500 may occur after manufacture or initial assembly (e.g., when a consumer purchases the electrical appliance 10).

Method 500 includes inserting 502 the upper mounting plate 182 within the upper pocket 300, and securing 504 the upper mounting plate 182 within the upper pocket 300 by selectively attaching the upper flap 302 to the upper pocket 300. Method 500 also includes inserting 506 the lower mounting plate 184 within the lower pocket 320, and securing 508 the lower mounting plate within the lower pocket 320 by selectively attaching the lower flap 322 to the lower pocket 320.

In some embodiments, the method 500 may include engaging the upper flap 302 with the upper pocket 320 and engaging the lower flap 322 with the lower pocket 320. For example, the user may reach into the first and second auxiliary pockets 314, 334 to access the first and second attachment features of the upper pocket 300 and the lower pocket 320, in the illustrated embodiment, the hook and loop fasteners 312, 332. Specifically, a user may reach into the first auxiliary pocket 314 in order to pull the upper flap 302 taught and press together the hook and loop fasteners 321 to engage the upper flap 302 with the upper pocket 300. Likewise, a user may reach into the second auxiliary pocket 334 in order to pull the lower flap 322 taught and press together the hook and loop fasteners 321 to engage the lower flap 322 with the lower pocket 320.

Figure 20:
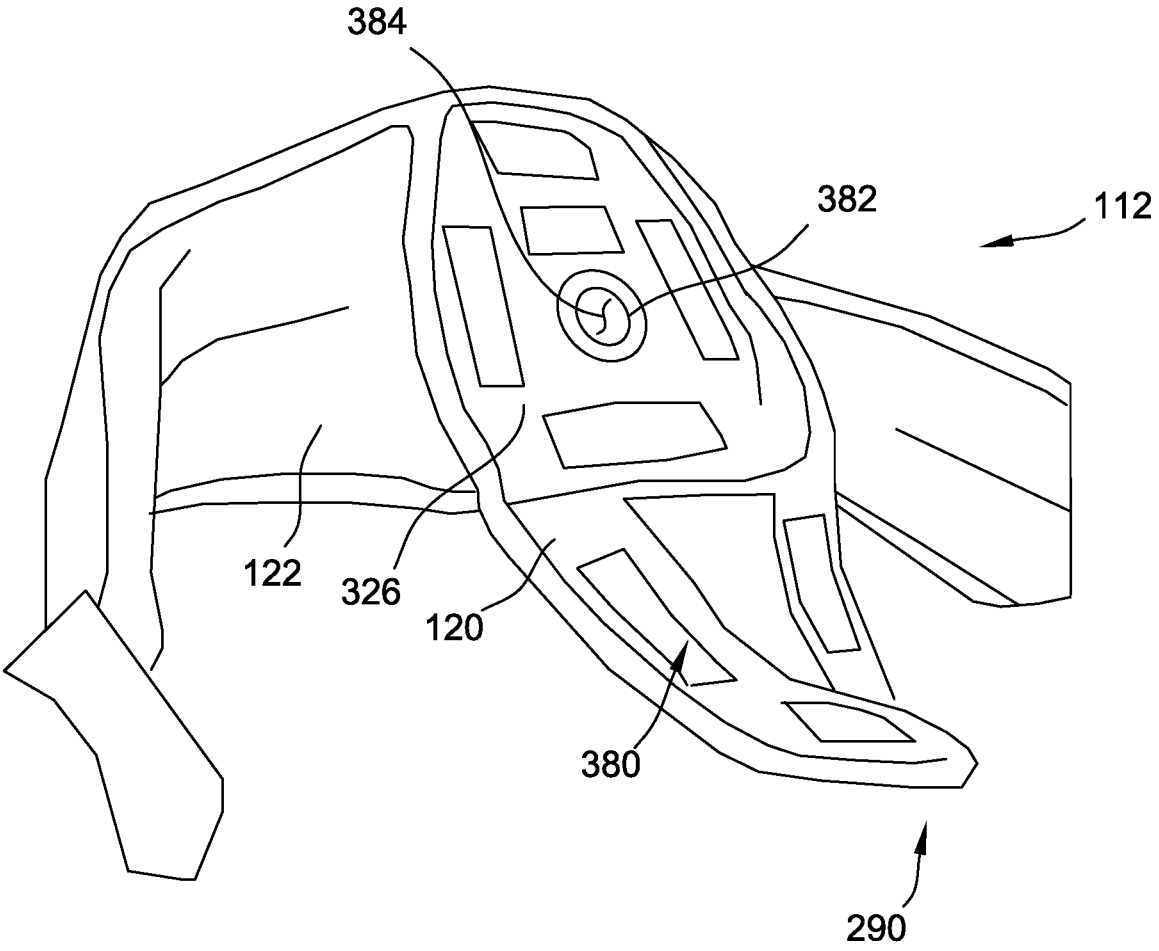
FIG. 20 is a perspective view of the first side of the lower support assembly showing an access for use during the method of FIG. 19.

The method 500 also includes connecting 510 the upper mounting plate 182 to the housing 130, and connecting 514 lower mounting plate 184 to the housing 130. In some embodiments, the method 500 also includes rotationally connecting 512 the lower shoulder strap mount 186 to the lower mounting plate 184. For example, after the lower mounting plate 184 has been placed within the lower pocket 320, the second annular wall of the lower mounting plate 184 extends outside of the lower pocket 320 through the lower aperture 336 in the lower pocket 320. The lower shoulder strap mount 186 can be rotatably connected to the second annular wall 230 of the lower mounting plate 184. Connecting 514 the lower mounting plate 184 to the housing 130 can include inserting the first annular wall 218 within the second annular wall 230, and inserting the fastener 249 into the lower fastener opening 220 of the appliance 10. The fastener 249 may be inserted through an access panel 380 on the first side 290 of the lower back pad 120, as shown in FIG. 20. The access panel 380 provides access to the back cover 326. The back cover 326 defines a boundary 382 of an opening 384 passing through the back cover 326. The opening 384 is sized and shaped such that the fastener 249 may be inserted through the opening 384, through the second keyed bore 248 and received in the lower fastener opening 220 defined on the lower attachment 214. The access panel 380 may be selectively opened and/or closed in order to access the opening 384 and the back cover 326 for connecting the lower mounting plate 184 to the housing 130. Additionally, the access panel 380 may be selectively closed to cover opening 384 and the back cover 326. For example, the access panel 380 and the lower back pad 120 may include suitable attachment features, e.g., hook and loop fasteners, zippers, and/or clasps, enabling the access panel 380 to be selectively closed and/or opened relative to the lower back pad 120. The upper back pad 114 can include an upper access panel and an opening that are substantially similar to the access panel 380 and opening 384 shown in FIG. 20. For example, the back cover 306 may define a boundary of an opening that is sized and shaped such that the fastener 249 may be inserted through the opening and into the first keyed bore 222 and within the upper fastener opening 226 defined on the upper attachment 212. Likewise, the upper access panel may be selectively opened and/or closed similar to the access panel 380. The steps of connecting 510 the upper mounting plate 182, rotationally connecting 512 the lower shoulder strap mount 186, and connecting 514 the lower mounting plate 184 can be performed before or after the upper and lower mounting plates 182, 184 are inserted and secured within their respective pockets 300 and 320.

Embodiments of the interchangeable harness assemblies described herein have several advantages over other known backpack style appliances. For example, embodiments of the harness assemblies described herein include upper and lower support assemblies that each include a pocket that enables a user to quickly, and without the use of additional tools, equipment, and/or machinery, connect and remove the harness assembly to and from the appliance. For example, the appliance includes one or more mounting plates, And the upper and lower pockets are sized and shaped to receive the mounting plates therein. Further, an upper and lower flap of the upper and lower pockets, respectively, are selectively connectable (e.g., with hook and loop fasteners) to the respective pocket to secure the mounting plates with the pockets. The interchangeable harness assemblies of the present disclosure allow a user to maintain their own personal harness, remove the harness after use in order to wash or replace the harness, and/or connect the harness to a shared appliance. Additionally, in some embodiments, the harness assemblies facilitate independent movement of a user's arms and shoulders relative to their waist. For example, in some embodiments, a lower shoulder strap mount is connected to shoulder straps of the upper support assembly, and is rotatably connected to a lower mounting plate of the electrical appliance.

Example embodiments of interchangeable harness assemblies are described above in detail. The interchangeable harness assemblies are not limited to the specific embodiments described herein, but rather, components of the interchangeable harness assemblies may be used independently and separately from other components described herein. For example, the interchangeable harness assemblies and associated features described herein may be used with a variety of electrical appliances, including and without limitation, wet/dry vacuum cleaners, blowers, sprayers, and power tools. In yet other applications, the interchangeable harness assemblies described herein can be used with non-electrical appliances, such as any type of user-worn appliance, including, for example and without limitation, manual or hand-pump style backpacK sprayers.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A harness assembly for an electrical appliance, the harness assembly comprising:

an upper support assembly including an upper back pad and at least one shoulder strap emanating from the upper back pad, the upper back pad including a first side and an opposing second side, the first side adapted to engage a user's back when the harness assembly is worn by the user, wherein the upper back pad includes an upper pocket located on the second side of the upper back pad, the upper pocket sized and shaped to receive an upper mounting plate of the electrical appliance therein, wherein the upper pocket includes an upper aperture sized and shaped to receive a portion of the upper mounting plate therein such that the portion of the upper mounting plate extends out of the upper pocket through the upper aperture when the upper mounting plate is within the upper pocket, wherein the upper back pad further includes an upper flap selectively connectable to the upper pocket to close the upper pocket and retain the upper mounting plate within the upper pocket; and a lower support assembly including a lower back pad and a waist belt emanating from the lower back pad, the lower back pad including a first side and an opposing second side, the first side adapted to engage the user's back when the harness assembly is worn by the user, wherein the lower back pad includes a lower pocket located on the second side of the lower back pad, the lower pocket sized and shaped to receive a lower mounting plate of the electrical appliance therein, wherein the lower pocket includes a lower aperture sized and shaped to receive a portion of the lower mounting plate therein such that the portion of the lower mounting plate extends out of the lower pocket through the lower aperture when the lower mounting plate is within the lower pocket, wherein the lower back pad further includes a lower flap selectively connectable to the lower pocket to close the lower pocket and retain the lower mounting plate within the lower pocket.

2. The harness assembly of claim 1, wherein each of the upper flap and the lower flap includes a first attachment feature, wherein each of the upper pocket and the lower pocket includes a second attachment feature, wherein the first attachment feature is selectively engageable with the second attachment feature such that the upper flap is selectively attachable to the upper pocket, and the lower flap is selectively attachable to the lower pocket.

3. The harness assembly of claim 1 in combination with the lower mounting plate, wherein the lower mounting plate includes a lower frame and an annular wall extending from the lower frame, wherein the lower frame is sized and shaped to fit within the lower pocket, and wherein the lower aperture is sized and shaped to receive at least a portion of the annular wall therein such that the annular wall extends out of the lower pocket through the lower aperture when the lower mounting plate is within the lower pocket.

4. The harness assembly of claim 3, wherein the annular wall is sized and shaped to receive a lower attachment of the electrical appliance to connect the lower mounting plate to the electrical appliance.

5. The harness assembly of claim 1, in combination with the upper mounting plate, wherein the upper mounting plate includes an upper frame including a keyed boundary defining a keyed bore, wherein the keyed bore is sized and shaped to receive a keyed shaft of the electrical appliance to connect the upper mounting plate to the electrical appliance.

6. The harness assembly of claim 5, wherein the keyed boundary is accessible through the upper aperture when the upper mounting plate is within the upper pocket.

7. The harness assembly of claim 1, wherein the at least one shoulder strap includes a second end adjustably connected to a lower shoulder strap mount of the electrical appliance.

8. The harness assembly of claim 1, wherein the at least one shoulder strap includes a first shoulder strap and a second shoulder strap, each of the first shoulder strap and the second shoulder strap including a second end that is adjustably connected to a lower shoulder strap mount.

9. The harness assembly of claim 1, wherein at least one of the upper support assembly and the lower support assembly includes an auxiliary pocket.

10. The harness assembly of claim 1, wherein the harness assembly includes at least one accessory coupler connected to one of the waist belt and the at least one shoulder strap, wherein the accessory coupler is adapted to couple an accessory to the harness assembly.

11. The harness assembly of claim 1, wherein the upper pocket includes a front cover and a back cover, wherein the front and back covers cooperatively define an upper opening that provides access to the upper pocket, wherein the upper flap is attached to the back cover and is selectively connectable to the front cover to occlude the upper opening.

12. The harness assembly of claim 11, wherein the upper aperture is defined in the front cover of the upper pocket.

13. The harness assembly of claim 1, wherein the lower pocket includes a front cover and a back cover, wherein the front and back covers cooperatively define a lower opening that provides access to the lower pocket, wherein the lower flap is attached to the back cover and is selectively connectable to the front cover to occlude the lower opening.

14. The harness assembly of claim 13, wherein the lower aperture is defined in the front cover of the lower pocket.

15. A harness assembly for an electrical appliance in combination with a lower mounting plate of the electrical appliance, wherein the harness assembly comprises:

an upper support assembly including an upper back pad and at least one shoulder strap emanating from the upper back pad, the upper back pad including a first side and an opposing second side, the first side adapted to engage a user's back when the harness assembly is worn by the user, wherein the upper back pad includes an upper pocket located on the second side of the upper back pad, the upper pocket sized and shaped to receive an upper mounting plate of the electrical appliance therein, wherein the upper back pad further includes an upper flap selectively connectable to the upper pocket to close the upper pocket and retain the upper mounting plate within the upper pocket; and a lower support assembly including a lower back pad and a waist belt emanating from the lower back pad, the lower back pad including a first side and an opposing second side, the first side adapted to engage the user's back when the harness assembly is worn by the user, wherein the lower back pad includes a lower pocket located on the second side of the lower back pad, the lower pocket sized and shaped to receive the lower mounting plate therein, wherein the lower back pad further includes a lower flap selectively connectable to the lower pocket to close the lower pocket and retain the lower mounting plate within the lower pocket;

wherein the lower mounting plate includes a lower frame and an annular wall extending from the lower frame, wherein the lower frame is sized and shaped to fit within the lower pocket; and wherein the lower pocket includes a lower aperture sized and shaped to receive at least a portion of the annular wall therein such that the annular wall extends out of the lower pocket through the lower aperture when the lower mounting plate is within the lower pocket.

16. The harness assembly and lower mounting plate of claim 15, wherein the annular wall is sized and shaped to receive a lower attachment of the electrical appliance to connect the lower mounting plate to the electrical appliance.

17. The harness assembly and lower mounting plate of claim 15, wherein each of the upper flap and the lower flap includes a first attachment feature, wherein each of the upper pocket and the lower pocket includes a second attachment feature, wherein the first attachment feature is selectively engageable with the second attachment feature such that the upper flap is selectively attachable to the upper pocket, and the lower flap is selectively attachable to the lower pocket.

18. A harness assembly for an electrical appliance in combination with an upper mounting plate of the electrical appliance, wherein the harness assembly comprises:

an upper support assembly including an upper back pad and at least one shoulder strap emanating from the upper back pad, the upper back pad including a first side and an opposing second side, the first side adapted to engage a user's back when the harness assembly is worn by the user, wherein the upper back pad includes an upper pocket located on the second side of the upper back pad, the upper pocket sized and shaped to receive the upper mounting plate therein, wherein the upper back pad further includes an upper flap selectively connectable to the upper pocket to close the upper pocket and retain the upper mounting plate within the upper pocket; and a lower support assembly including a lower back pad and a waist belt emanating from the lower back pad, the lower back pad including a first side and an opposing second side, the first side adapted to engage the user's back when the harness assembly is worn by the user, wherein the lower back pad includes a lower pocket located on the second side of the lower back pad, the lower pocket sized and shaped to receive a lower mounting plate of the electrical appliance therein, wherein the lower back pad further includes a lower flap selectively connectable to the lower pocket to close the lower pocket and retain the lower mounting plate within the lower pocket;

wherein the upper mounting plate includes an upper frame including a keyed boundary defining a keyed bore, wherein the keyed bore is sized and shaped to receive a keyed shaft of the electrical appliance to connect the upper mounting plate to the electrical appliance.

19. The harness assembly and upper mounting plate of claim 18, wherein the keyed boundary is accessible through an upper aperture defined in the upper pocket when the upper mounting plate is within the upper pocket.

20. The harness assembly and upper mounting plate of claim 18, wherein each of the upper flap and the lower flap includes a first attachment feature, wherein each of the upper pocket and the lower pocket includes a second attachment feature, wherein the first attachment feature is selectively engageable with the second attachment feature such that the upper flap is selectively attachable to the upper pocket, and the lower flap is selectively attachable to the lower pocket.

* * * * *